US007309120B2

(12) United States Patent
Hatsui et al.

(10) Patent No.: US 7,309,120 B2
(45) Date of Patent: Dec. 18, 2007

(54) HEAD SUBSTRATE, PRINTHEAD, HEAD CARTRIDGE, PRINTING APPARATUS, AND METHOD FOR INPUTTING/OUTPUTTING INFORMATION

(75) Inventors: Takuya Hatsui, Tokyo (JP); Yoshiyuki Imanaka, Kawasaki (JP); Teruo Ozaki, Yokohama (JP); Yoshiyuki Toge, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/564,704

(22) Filed: Nov. 29, 2006

(65) Prior Publication Data

US 2007/0091131 A1 Apr. 26, 2007

Related U.S. Application Data

(63) Continuation of application No. PCT/JP2005/009898, filed on May 30, 2005.

(30) Foreign Application Priority Data

Jun. 2, 2004 (JP) ..... 2004-164555
May 23, 2005 (JP) ..... 2005-149619

(51) Int. Cl.
*B41J 2/05* (2006.01)

(52) U.S. Cl. ..... 347/59; 347/9; 347/12

(58) Field of Classification Search ..... 347/59, 347/9, 12

See application file for complete search history.

(56) References Cited

U.S. PATENT DOCUMENTS 5,126,759 A 6/1992 Small et al.
5,166,702 A 11/1992 Mattern et al.
5,253,934 A 10/1993 Potucek et al.
5,264,868 A 11/1993 Hadley et al.
5,363,134 A 11/1994 Barbehenn et al.
5,471,163 A * 11/1995 Childers ..... 327/525
5,610,635 A * 3/1997 Murray et al. ..... 347/7
5,956,052 A 9/1999 Udagawa et al.

(Continued)

FOREIGN PATENT DOCUMENTS

EP 0 571 093 A2 11/1993

(Continued)

*Primary Examiner*—Thinh Nguyen
(74) *Attorney, Agent, or Firm*—Fitzpatrick, Cella, Harper & Scinto

(57) ABSTRACT

An object of this invention is to provide a safe and reliable head substrate having a fuse ROM without increasing the substrate size. To achieve the object, a head substrate includes a plurality of printing elements for printing, first driving elements which drive the printing elements, a fuse ROM which stores information, a second driving element which drives the fuse ROM, input device for inputting a printing signal to cause the plurality of printing elements to print and a block selection signal to time-divisionally drive the printing elements, selective driving device for selectively driving the first driving elements on the basis of the input printing signal and block selection signal, a first pad which applies a first voltage to the fuse ROM to write information, and a second pad which applies a second voltage to read out the information from the fuse ROM. In order to selectively drive the second driving element to operate the fuse ROM, the second driving element connects to the selective driving device, and the fuse ROM is selectively operative on the basis of the signals input from the input device.

18 Claims, 23 Drawing Sheets

U.S. PATENT DOCUMENTS

| | | | | |
|---|---|---|---|---|
| 6,130,692 | A | 10/2000 | Mochizuki et al. | |
| 6,390,589 | B1 * | 5/2002 | Imanaka et al. | 347/19 |
| 6,820,958 | B2 * | 11/2004 | Miyakoshi | 347/17 |
| 7,029,081 | B1 | 4/2006 | Imanaka et al. | |
| 7,216,960 | B2 | 5/2007 | Imanaka et al. | |
| 2002/0140751 | A1 | 10/2002 | Imanaka et al. | |
| 2005/0285904 | A1 | 12/2005 | Toge et al. | |
| 2006/0238558 | A1 | 10/2006 | Hatasa et al. | |
| 2007/0002087 | A1 | 1/2007 | Matsui et al. | |
| 2007/0008382 | A1 | 1/2007 | Hatsui et al. | |

FOREIGN PATENT DOCUMENTS

| | | |
|---|---|---|
| EP | 0 997 280 A2 | 5/2000 |
| JP | 62-288065 (A) | 12/1987 |
| JP | 3-126560 (A) | 5/1991 |
| JP | 5-501684 (A) | 4/1993 |
| JP | 6-957 (A) | 1/1994 |
| JP | 6-91877 (A) | 4/1994 |
| JP | 10-138482 (A) | 5/1998 |
| JP | 2000-198202 (A) | 7/2000 |
| JP | 3428683 (B2) | 5/2003 |
| WO | WO92/00196 | 1/1992 |

* cited by examiner

HEAD SUBSTRATE, PRINTHEAD, HEAD CARTRIDGE, PRINTING APPARATUS, AND METHOD FOR INPUTTING/OUTPUTTING INFORMATION

This application is a continuation application of International Application No. PCT/JP2005/009898, filed on May 30, 2005.

TECHNICAL FIELD

The present invention relates to a head substrate, printhead, head cartridge, printing apparatus, and method for inputting/outputting information and, more particularly, to, e.g., a head substrate having a fuse ROM for holding/reading information, a printhead or head cartridge using the head substrate, a printing apparatus using the printhead or head cartridge, and a method for inputting/outputting information to/from the head substrate.

BACKGROUND ART

There is a proposal to arrange a ROM (Read Only Memory) on a head substrate integrated on an inkjet printhead (to be referred to as a printhead hereinafter) included in a recent inkjet printing apparatus (to be referred to as a printing apparatus hereinafter) to freely read out or hold information (individual information) unique to the head, including the ID (Identify) code of the printhead itself and the driving characteristic of the ink discharge mechanism.

In an arrangement using a printhead detachable from a printing apparatus main body, this approach is especially effective in acquiring information unique to the printhead. Patent reference 1 discloses arranging an EEPROM (Electrically Erasable Programmable ROM) in a printhead.

In another known method, a resistance indicating information unique to a head is formed on the base substrate of a head substrate together with the layer films of, e.g., an ink discharge mechanism. This approach is effective when the amount of information to be held in the printhead is relatively small. This method also allows a printing apparatus to obtain information unique to the printhead by reading the value of the resistance formed on the base substrate. The printing apparatus is capable of optimum driving for ink discharge based on the information.

Patent reference 2 discloses forming, on a base substrate used for manufacturing a head substrate, a fuse serving as a ROM (to be referred to as a fuse ROM hereinafter) simultaneously together with the layer films of, e.g., an ink discharge mechanism. When the fuse ROM is selectively melted under the control of a simultaneously formed logic circuit, the fuse ROM can hold binary data based on the presence/absence of the fuse.

A printhead having the above-described head substrate can simplify the structure, improve the productivity, reduce the cost, and reduce the weight and size while holding the information unique to the head.

Patent reference 1: Japanese Patent Publication Laid-Open No. 3-126560

Patent reference 2: Japanese Patent Publication No. 3428683

DISCLOSURE OF INVENTION

Problems that the Invention is to Solve

However, the printhead capable of storing individual information as described above in the prior art has the following problems to solve.

If the amount of data to be stored is large, it is useful to use an arrangement including a ROM chip such as an EEPROM separately from a head substrate. However, this inevitably increases the cost. Especially, when the amount of data to be stored is not large, a product according to this arrangement is not competitive in price in view of recent cost reduction of printing apparatuses. The printhead is also disadvantageous with regard to increasing productivity and reducing size and weight.

If the amount of data to be stored is not large, a storage device is preferably arranged on the head substrate. Hence, an EEPROM with a relatively small capacity may be arranged on the already proposed head substrate. However, the entire head substrate becomes expensive because of the increase in number of processes of forming the substrate. For this reason, cost reduction cannot be achieved similar to the arrangement including the separate ROM chip.

If the amount of data to be stored is not large, it is also possible to arrange, as a fuse ROM which serves as means for storing information, a heat generating element serving as an electrothermal transducer or a POLY wiring used as the gate wiring of a logic circuit, and simultaneously, apply the conventional manufacturing process to the logic circuit without increasing the number of processes of forming the substrate. In this method, the cost of wafer manufacture before individual substrates are formed is the same as before. Hence, it is possible to arrange a fuse ROM on a head substrate while suppressing the cost.

However, to print a high-quality image, the density of circuits in the head substrate is already high. The fuse ROM newly arranged on the head substrate must not damage the functions of the other circuits upon selective melting or reading (e.g., energy applied to an electrothermal transducer may damage the transducer). Alternatively, it is necessary to sufficiently consider the layout of the fuse ROM so as not to erroneously rupture it by the operation of the other circuits. For example, no other circuit can be formed on, under, or near the fuse ROM because melting of the fuse ROM may damage the function of the neighboring circuit. This inevitably leads to an increase in the area of the head substrate, and poses a serious problem in layout design of the head substrate.

This indicates that reduction of the production cost of the head substrate is difficult, and its development and safety/reliability check are time-consuming.

To melt a plurality of fuse ROMs or read from these fuse ROMs, means for selecting one of them is necessary. If a signal line connected to a fuse RON connects to the outside of the head substrate to output a signal to the outside, electrode pads equal in number to fuse ROMs are necessary on the head substrate to connect them to the external signal lines. The amount of data to be stored in the fuse ROMs after manufacturing and assembling the printhead is several ten bits. This is not a large amount. To ensure pads to input/output such information on the head substrate, a considerable space is necessary, resulting in a bulky head substrate. In addition, the number of signal lines outside the head substrate also increases in correspondence with the number of pads.

To reduce the number of signal lines, the fuses may be driven selectively. However, this method requires to add, in the head substrate, a logic circuit such as a driving element transistor having a driving capability for fusing or a shift register to be used to select any desired fuse and a wiring for the logic circuit. As a result, the head substrate requires an extra space.

FIG. 23 is a view showing the layout of a conventional head substrate.

To reliably store information, i.e., to reliably melt the fuse and reliably read out stored information, the energy to be applied to the fuse must largely change between read and fusing to store the information. To do this, separate circuits are necessary for melting and read, requiring an additional space. This also results in a bulky head substrate.

Many conventional head substrates have a large ink supply port to supply ink from the lower surface side to the upper surface side of the substrate. For this reason, it is necessary to lay out, on the head substrate, electrothermal transducers and driving circuits and wirings to select the electrothermal transducers while avoiding the ink supply port, resulting in difficulty in layout. It is more difficult to arrange a fuse and its circuit on such a head substrate having an ink supply port.

The present invention has been made to solve the above-described problems, and has as its object to provide a reliable and safe head substrate having a storage element such as a fuse ROM without largely increasing the head substrate size, a printhead using the head substrate, a head cartridge using the printhead, a printing apparatus using the printhead or head cartridge, and a method for inputting/outputting information.

Means of Solving the Problems

In order to achieve the above object, a head substrate according to the present invention has the following arrangement.

More specifically, it is characterized by comprising: a plurality of printing elements for printing; a plurality of first driving elements which correspond to the plurality of printing elements, respectively, for driving the plurality of printing elements; a fuse ROM which stores information; a second driving element for driving the fuse ROM; input means for inputting a printing signal to cause the plurality of printing elements to print and a block selection signal to time-divisionally drive the plurality of printing elements; selective driving means for selectively driving the plurality of first driving elements on the basis of the printing signal and the block selection signal input by the input means; a first pad for applying a first voltage to the fuse ROM to write information; and a second pad for applying a second voltage to read out the information from the fuse ROM, wherein, in order to selectively drive the second driving element to operate the fuse ROM, the second driving element connects to the selective driving means, and the fuse ROM is selectively operative on the basis of signals input from the input means.

The input means preferably comprises a shift register for serially inputting the printing signal, and a latch circuit for latching the printing signal input by the shift register. The selective driving means preferably comprises: a decoder circuit for receiving the block selection signal as part of an output signal from the latch circuit, and generating a time-division selection signal to time-divisionally drive the plurality of printing elements, and an AND circuit for receiving the time-division selection signal and the printing signal as part of the output signal from the latch circuit, and calculating a logical product.

Note that a voltage applied to the plurality of printing elements substantially equals the first voltage, and they are preferably, e.g., 24 V. In this case, the first driving element and the second driving element preferably have substantially the same tolerable voltage. On the other hand, a voltage that drives the input means and the selective driving circuit substantially equals the second voltage, and they are preferably, e.g., 3.3 V.

The input means preferably inputs a fuse ROM selection signal to select operating the fuse ROM.

The following arrangements are conceivable to increase the reliability and safety of the circuits included in the head substrate.

(1) The AND circuit further inputs a heat enable signal to energize and drive the plurality of first driving elements and the second driving element.

(2) Only the AND circuit provided to energize and drive the plurality of first driving elements further inputs a heat enable signal.

(3) In addition to the arrangement (2), the AND circuit provided to drive the second driving element further inputs a latch signal to instruct a latch operation of the latch circuit.

To output a low-level (L) signal if the fuse ROM is not open, a resistor connected between the first pad and the second pad has a resistance value much higher than that of the fuse ROM.

In head substrate, preferably, the plurality of printing elements comprise electrothermal transducers, and printing is executed by energizing the electrothermal transducers to generate heat and discharging ink by using the generated heat. In this case, the head substrate preferably further comprises a rectangular ink supply port to supply the ink from an outside. This arrangement preferably has such a layout that the plurality of printing elements are arrayed along both long sides of the ink supply port, the plurality of first driving elements are arrayed along a further side of the array of the printing elements spaced apart from the long side of the ink supply port, and the second driving element is arranged at least at one end of the array of the first driving elements.

According to another aspect of the invention, there is provided a printhead using a head substrate having the above arrangement.

According to still another aspect of the invention, there is provided an ink cartridge having the printhead and an ink tank which stores ink to be supplied to the printhead.

According to still another aspect of the invention, there is provided a printing apparatus which prints by using a printhead or head cartridge with the above arrangement.

The printing apparatus preferably further comprises write means for writing information in the fuse ROM by applying the first voltage to the first pad, read means for reading out information from the fuse ROM by applying the second voltage to the second pad, and switching means for switching information write/read in/from the fuse ROM and a normal printing operation by transmitting the fuse selection signal.

According to still another aspect of the invention, there is provided a method for inputting/outputting information to/from a head substrate with the above arrangement, characterized by comprising a switching step of switching information write/read in/from the fuse ROM and a normal printing operation by transmitting the fuse selection signal to the head substrate, a write step of writing information in the fuse ROM by applying the first voltage to the first pad, and a read step of reading out information from the fuse ROM by applying the second voltage to the second pad.

Effects of the Invention

Hence, according to the present invention, the input means and selective driving circuit which should actually be used for printing can be used to operate the fuse ROM. Since the circuits are shared, and no additional circuit arrangement is necessary for the operation of the fuse ROM, the head substrate size does not increase. The input means and selective driving circuit for printing are designated with high safety and reliability. Hence, it is possible to ensure high safety and reliability even for the operation of the fuse ROM by sharing the circuits.

Other features and advantages of the present invention will be apparent from the following descriptions taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF THE REFERENCE NUMERALS

| | |
|---|---|
| H1000, H1001 | printhead cartridge |
| H1100, H1101 | printhead |
| H1102 | ink supply port |
| H1103 | electrothermal transducer |
| H1104 | electrode |
| H1105 | bump |
| H1106 | ink channel wall |
| H1107 | orifice |
| H1108 | orifice group |
| H1110 | head substrate |
| H1111 | resistance for readout |
| H1116 | driving element |
| H1117 | fuse |
| H1200, H1201 | ink supply port |
| H1300, H1301 | electric wiring tape |
| H1302 | external signal input terminal |
| H1303 | opening |
| H1304 | electrode terminal |
| H1500, H1501 | ink supply holding member |
| H1560 | attachment guide |
| H1570, H1580, H1590 | butt portion |
| H1600, H1601, H1602, H1603 | ink absorber |
| H1700, H1701, H1702, H1703 | filter |
| H1800, H1801 | seal member |
| H1900 | lid member |

BEST MODE FOR CARRYING OUT THE INVENTION

Preferred embodiments of the present invention will be described below in detail with reference to the accompanying drawings.

In this specification, the term "print" (also referred to as "printing") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be extensively interpreted similar to the definition of "print (printing)" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

Furthermore, unless otherwise stated, the term "nozzle" generally means a set of a discharge orifice, a liquid channel connected to the orifice and an element to generate energy utilized for ink discharge.

A printhead substrate (head substrate) indicates not a simple base made of silicon semiconductor but a structure including elements and wirings.

"On a substrate" indicates not only the upper side of a head substrate but also the upper surface of the head substrate and the inside of the head substrate near the upper surface. In the present invention, a term "built-in" indicates not simply separately arranging individual elements on the upper surface of a base but also integrally forming and manufacturing individual elements on an element substrate by, e.g., semiconductor circuit manufacturing steps.

<Basic Arrangement of Printing Apparatus (FIGS. 1 and 2)>

Figure 1:
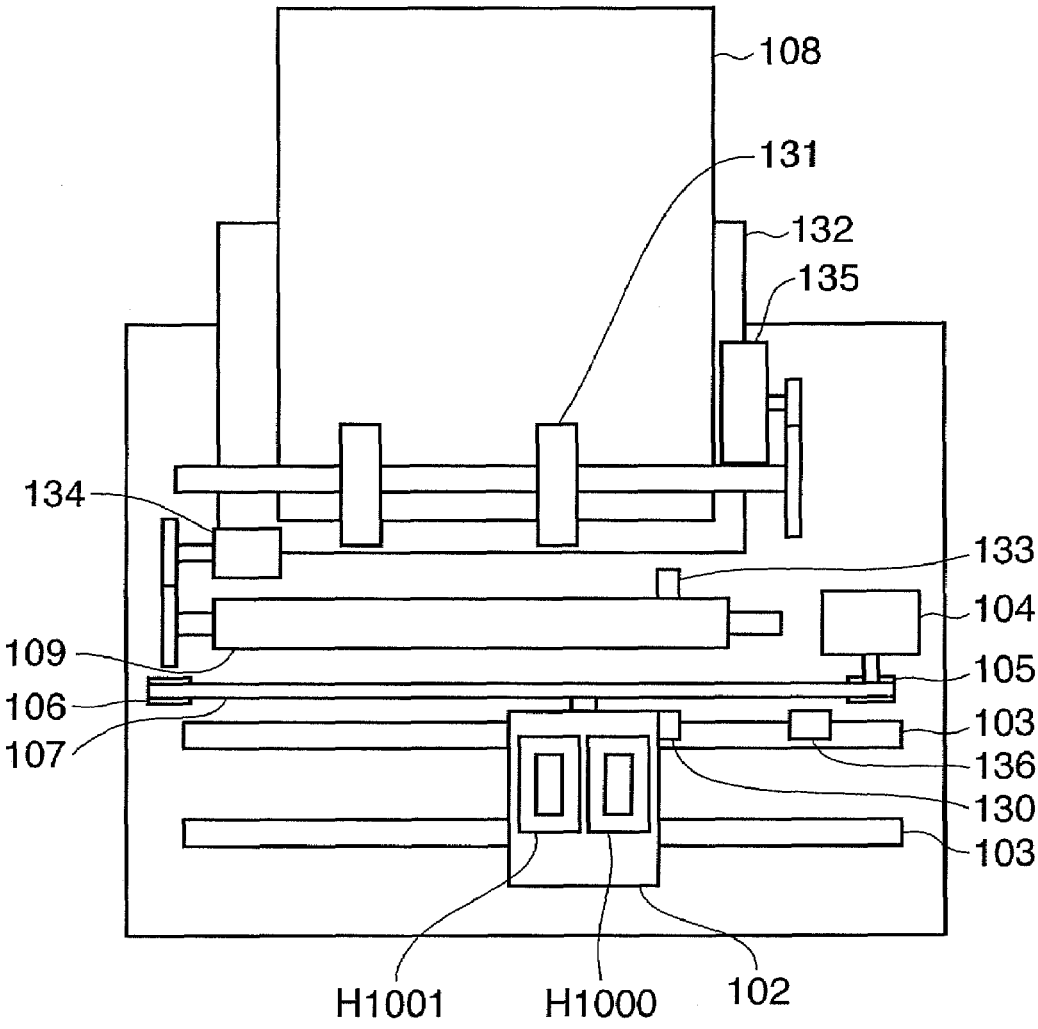
FIG. 1 is an explanatory view showing an example of a printing apparatus capable of including an inkjet printhead of the present invention.

FIG. 1 is an explanatory view showing an example of a printing apparatus capable of including an inkjet printhead or inkjet printhead cartridge (to be referred to as a printhead or printhead cartridge hereinafter) of the present invention.

As shown in FIG. 1, the printing apparatus has a carriage 102 having printhead cartridges H1000 and H1001 (to be described below) positioned and exchangeably mounted. The carriage 102 has an electrical connection portion to transmit driving signals to discharge portions through external signal input terminals on the printhead cartridges H1000 and H1001.

The carriage 102 is supported along a guide shaft 103 to be reciprocally movable. The guide shaft 103 runs in the main scanning direction in the apparatus main body. A carriage motor 104 drives the carriage 102 via a driving mechanism including a motor pulley 105, driven pulley 106, and timing belt 107 and controls the position and movement of the carriage 102. The carriage 102 has a home position sensor 130. The home position sensor 130 on the carriage 102 detects the home position when passing through the position of a shielding plate 136.

A feed motor 135 rotates pickup rollers 131 through a gear to separately feed each printing medium 108 on an automatic sheet feeder (ASF) 132. A conveyance roller 109 rotates to convey the printing medium 108 through a position (printing position) facing the orifice surfaces of the printhead cartridges H1000 and H1001. This conveyance direction is called a sub-scanning direction. Driving by a conveyance motor 134 is transmitted to the conveyance roller 109 through a gear. When the printing medium 108 passes through a paper end sensor 133, whether or not a paper sheet has been fed is determined, and the edge position in paper feeding is determined. The paper end sensor 133 is also used to determine the actual trailing edge position of the printing medium 108 and finally detect the current printing position from the actual trailing edge position.

A platen (not shown) supports the back surface of the printing medium 108 to form a flat print surface in the printing position. In this case, the printhead cartridges H1000 and H1001 mounted on the carriage 102 are held between two pairs of conveyance rollers to be parallel to the printing medium 108 while making the orifice surfaces projecting downward from the carriage 102.

The printhead cartridges H1000 and H1001 are mounted on the carriage 102 while making the array direction of orifices of each discharge portion intersect the scanning direction (main scanning direction) of the carriage 102. The printhead cartridges H1000 and H1001 discharge ink from the orifice arrays to print.

If a printhead cartridge having the same structure as that of the printhead cartridge H1001 and including light magenta, light cyan, and black inks replaces the printhead cartridge H1000, the printing apparatus can also serve as a high-quality photo printer.

A control arrangement to execute print control of the above-described printing apparatus will be described next.

Figure 2:
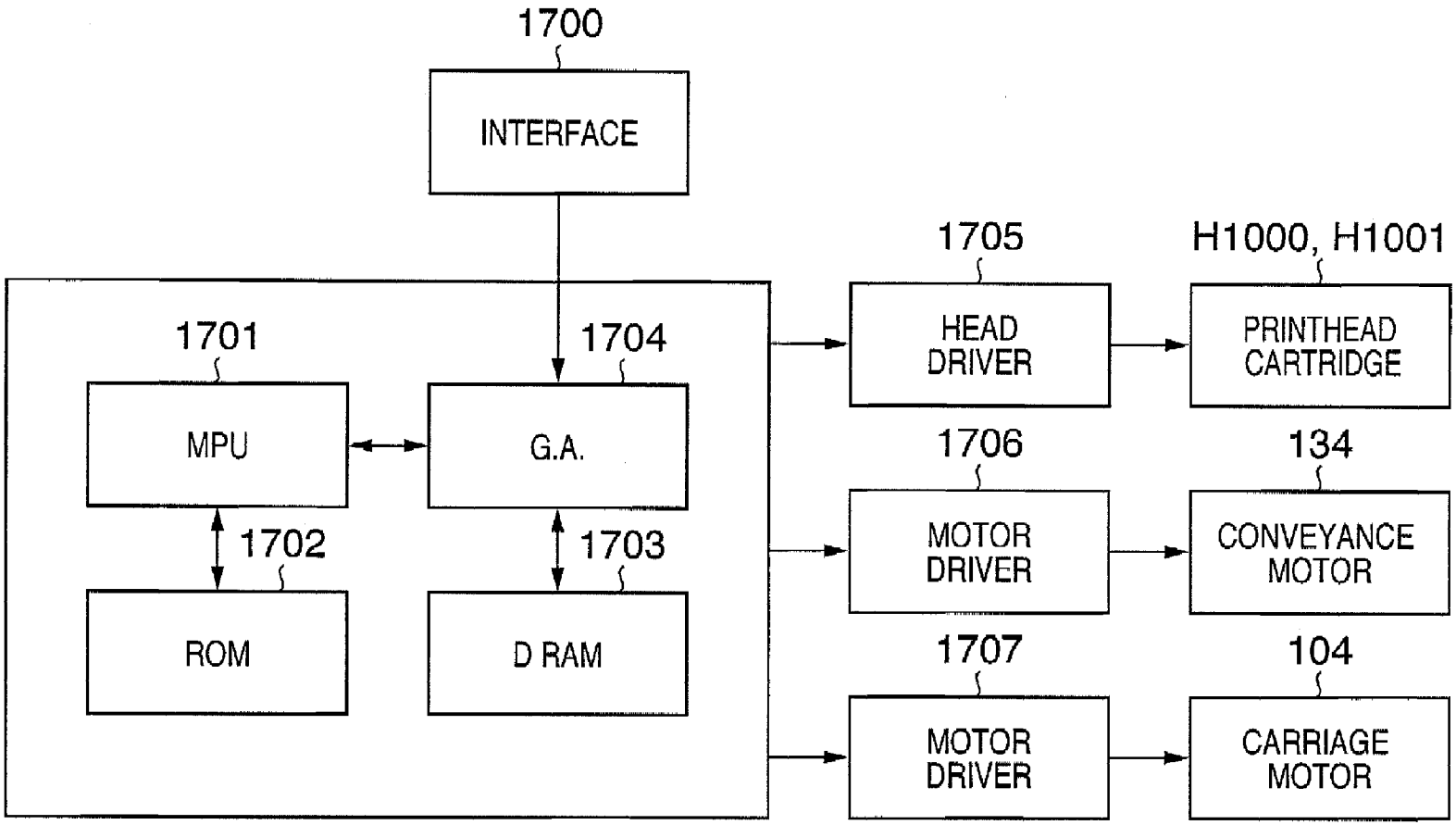
FIG. 2 is a block diagram showing the arrangement of the control circuit of the printing apparatus.

FIG. 2 is a block diagram showing the arrangement of the control circuit of the printing apparatus.

Referring to FIG. 2, reference numeral 1700 denotes an interface to input a printing signal; 1701, an MPU; 1702, a ROM that stores control programs to be executed by the MPU 1701; and 1703, a DRAM that saves various kinds of data (e.g., the printing signal and printing data to be supplied to the printhead cartridges). A gate array (G.A.) 1704 controls supply of printing data to the printhead cartridges H1000 and H1001. The gate array 1704 also controls data transfer between the interface 1700, MPU 1701, and RAM 1703.

A motor driver 1706 drives the conveyance motor 134. A motor driver 1707 drives the carriage motor 104.

The operation of the control arrangement will be described. A printing signal that has entered the interface 1700 is converted into printing data between the gate array 1704 and the MPU 1701. The motor drivers 1706 and 1707 are driven. The printhead cartridges H1000 and H1001 are driven in accordance with the printing data sent to the carriage 102 to print an image on the printing medium 108.

To optimally drive the printing element portions of the printhead cartridges H1000 and H1001, the driving method of each printing element is determined by referring to characteristic information held in the fuse ROMs of the head substrate (to be described later).

<Structure of Printhead (FIGS. 3 to 8)>

Figure 3:
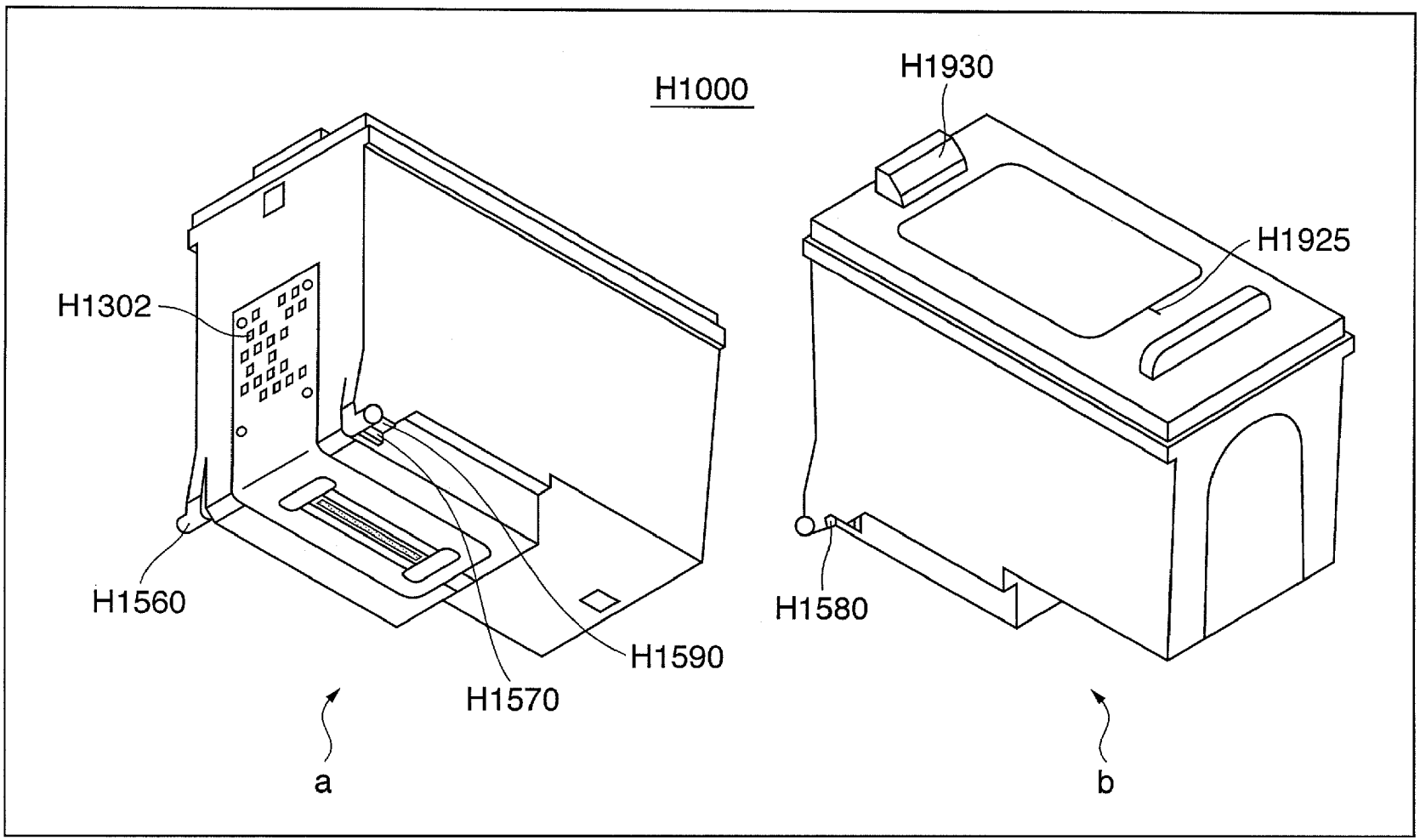
FIG. 3 is a perspective view showing the structure of a printhead cartridge H1000.
Figure 6:
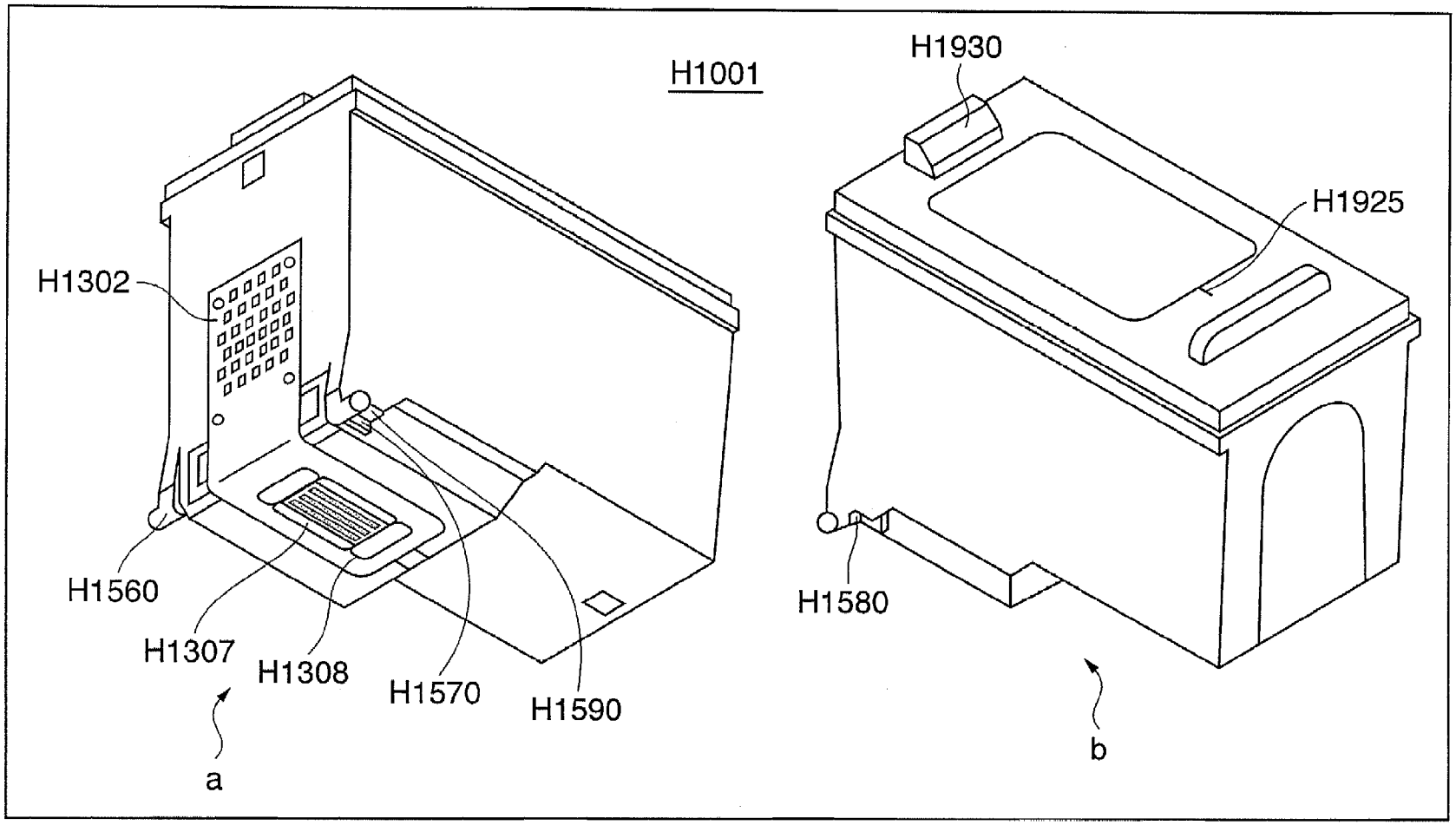
FIG. 6 is a perspective view showing the structure of a printhead cartridge H1001.

FIG. 3 is a perspective view showing the structure of the printhead cartridge H1000. FIG. 6 is a perspective view showing the structure of the printhead cartridge H101.

As shown in FIGS. 3 and 6, a printhead cartridge mounted on the printing apparatus according to this embodiment is a cartridge integrated with an ink tank and includes the printhead cartridge H1000 filled with black ink, as shown in FIGS. 3-*a* and 3-*b*, and the printhead cartridge H1001 filled with color inks (cyan ink, magenta ink, and yellow ink), as shown in FIGS. 6-*a* and 6-*b*. The printhead cartridges H1000 and H1001 are fixedly supported on the carriage 102 of the printing apparatus by positioning means and an electrical contact and are also detachable from the carriage 102. If the contained inks run out, the printhead cartridge can be exchanged.

The constituent elements of the printhead cartridges H1000 and H1001 will be described below in detail.

Each of the printhead cartridges H1000 and H1001 is a printhead having electrothermal transducers that generate thermal energy to cause film boiling in accordance with an electrical signal. The printhead cartridge has a so-called side-shooter printhead in which electrothermal transducers face ink orifices.

[Printhead Cartridge H1000]

Figure 4:
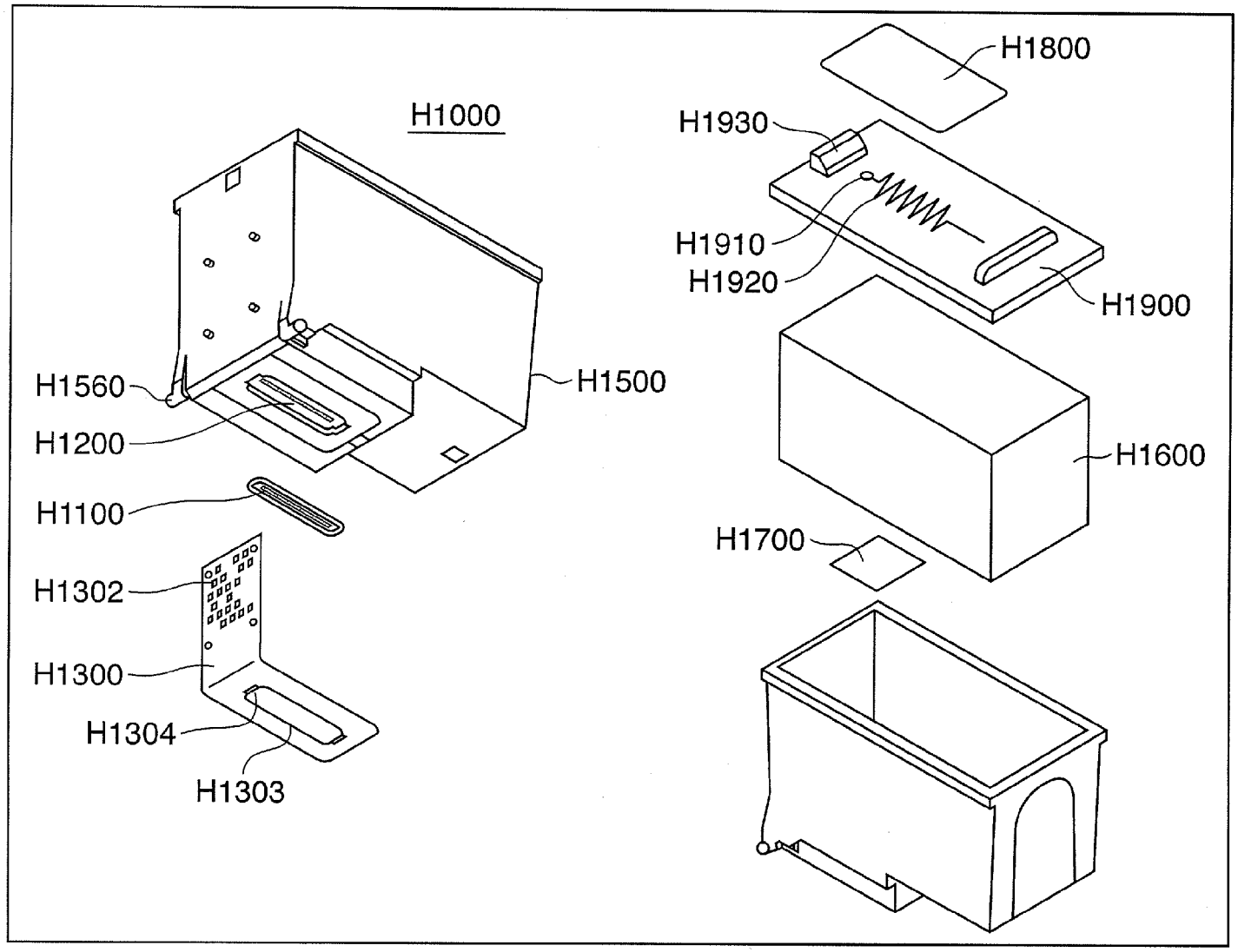
FIG. 4 is an exploded perspective view of the printhead cartridge H1000.

FIG. 4 is an exploded perspective view of the printhead cartridge H1000. The printhead cartridge H1000 includes a printhead H1100, electric wiring tape H1300, ink supply holding member H1500, filter H1700, ink absorber H1600, lid member H1900, and seal member H1800.

Printhead H1100

Figure 5:
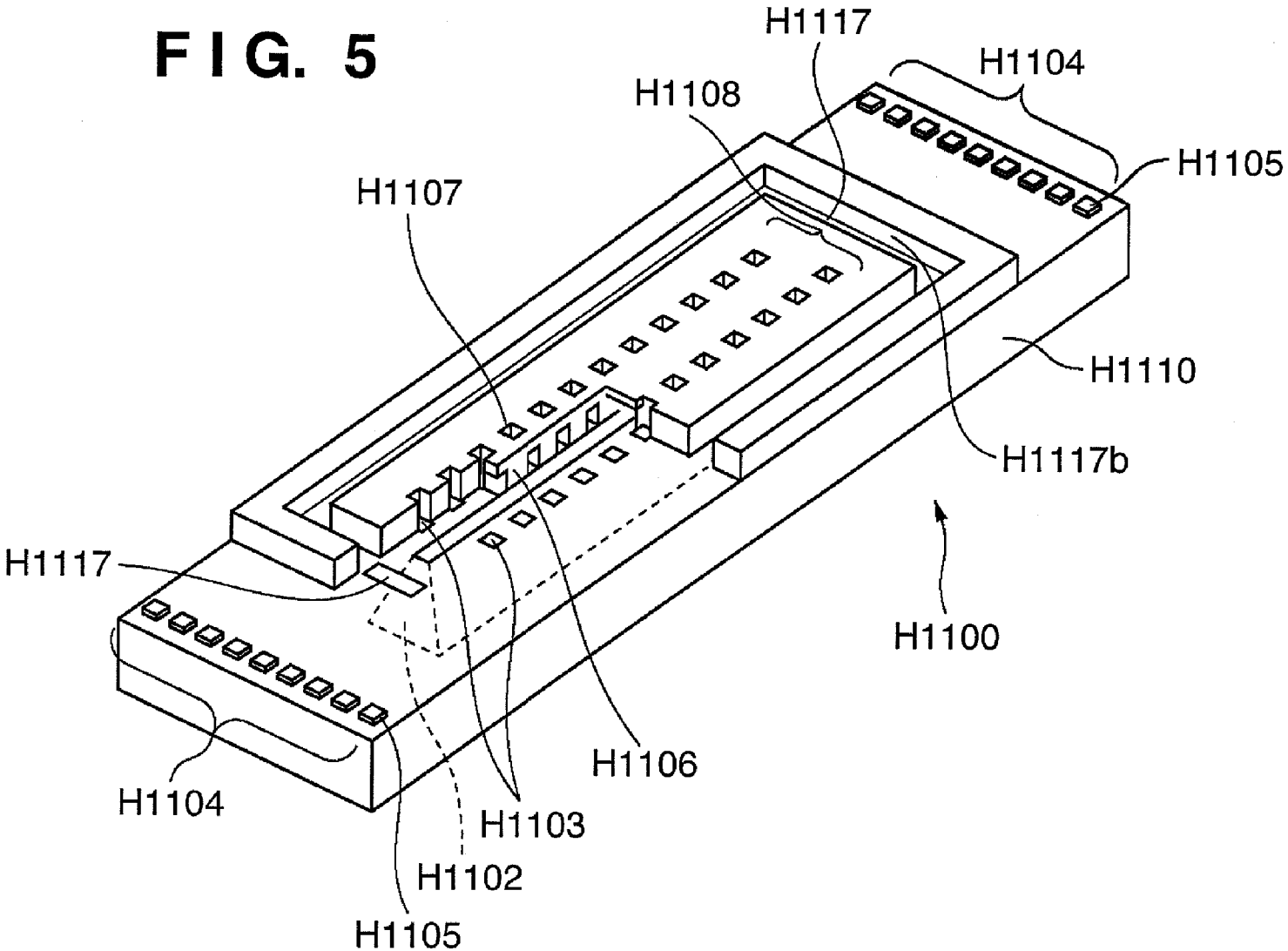
FIG. 5 is a partially cutaway perspective view for explaining the structure of a printhead H1100.

FIG. 5 is a partially cutaway perspective view for explaining the structure of the printhead H1100. The printhead H1100 includes a head substrate H1110 that is made of, e.g., a 0.5 to 1 mm thick Si substrate having an ink supply port H1102 serving as a through hole to flow ink from the lower surface of the substrate.

On the head substrate H1110, electrothermal transducers H1103 are arrayed along the ink supply port H1102 on its both sides (in this embodiment, an array of electrothermal transducers is arranged on each side of the ink supply port). In addition, electric wirings (not shown) made of, e.g., aluminum (Al) to power to the electrothermal transducers H1103 are arranged while being spaced apart from the ink supply port H1102 by a predetermined distance. It is possible to form the electrothermal transducers H1103 and electric wirings by using a conventional film formation technique. In this embodiment, the electrothermal transducers H1103 of the arrays on both sides of the ink supply port have a staggered pattern. That is, the positions of orifices H1107 of the two arrays slightly shift without being located on one line in a direction perpendicular to the arrays.

It goes without saying that the present invention incorporates any structure except the staggered pattern.

Electrodes (connection terminals) H1104 to supply, to the electric wirings, power or an electrical signal to drive the electrothermal transducers H1103 are arranged on the head substrate H1110 while being arrayed along the sides located at the two ends of each array of the electrothermal transducers H1103. Each electrode H1104 may have a bump H1105 made of, e.g., Au.

On the surface of the head substrate H1110 having a pattern of storage elements including the wirings and electrothermal transducers H1103, a structure made of resin material is formed by photolithography to form ink channels corresponding to the electrothermal transducers H1103. This structure has an ink channel wall H1106 to partition the ink channels and a ceiling portion to cover the upper part of the ink channel wall H1106. The orifices H1107 are open to the ceiling portion. The orifices H1107 correspond to the electrothermal transducers H1103, respectively, to form an orifice group H1108.

In the printhead H1100 having the above-described structure, ink supplied from the ink supply port H1102 is discharged from the orifices H1107 facing the electrothermal transducers H1103 by the pressure of bubbles created by the heat from the electrothermal transducers H1103.

Electric Wiring Tape H1300

The electric wiring tape H1300 forms an electrical signal path to apply an electrical signal to the printhead H1100 to discharge ink. The electric wiring tape H1300 has an opening H1303 to set the printhead H1100 in it. The electric wiring tape H1300 also has external signal input terminals H1302 to receive an electrical signal from the printing apparatus. The external signal input terminals H1302 and electrode terminals H1304 are coupled by an interconnection pattern of a continuous copper foil.

For example, when the bumps H1105 formed on the electrodes H1104 of the printhead H1100 join to the electrode terminals H1304 of the electric wiring tape H1300 corresponding to the electrodes H1104 of the printhead H1100, electrical connection between the electric wiring tape H1300 and the printhead H1100 is ensured.

Ink Supply Holding Member H1500

As shown in FIG. 4, the ink supply holding member H1500 implements the function of an ink tank by having the absorber H1600 to hold ink inside and generate negative pressure and the ink supply function by forming an ink channel to guide the ink to the printhead H1100.

The ink supply holding member H1500 has an ink supply port H1200 to supply black ink to the printhead H1100. The printhead H1100 is accurately bonded to the ink supply holding member H1500 to make the ink supply port H1102 (FIG. 5) of the printhead H1100 communicate with the ink supply port H1200 of the ink supply holding member H1500.

Lid Member H1900

The lid member H1900 has a fine port H1910 to let a pressure variation in the ink supply holding member H1500 relax and a fine groove H1920 communicating with the fine port H1910. The seal member H1800 covers most part of the fine port H1910 and fine groove H1920 while keeping one end of the fine groove H1920 open, thereby forming an air communicating port H1925 (FIG. 3). The lid member H1900 has an engaging portion H1930 to fix the printhead cartridge H1000 to the printing apparatus.

[Printhead Cartridge H1001]

Figure 7:
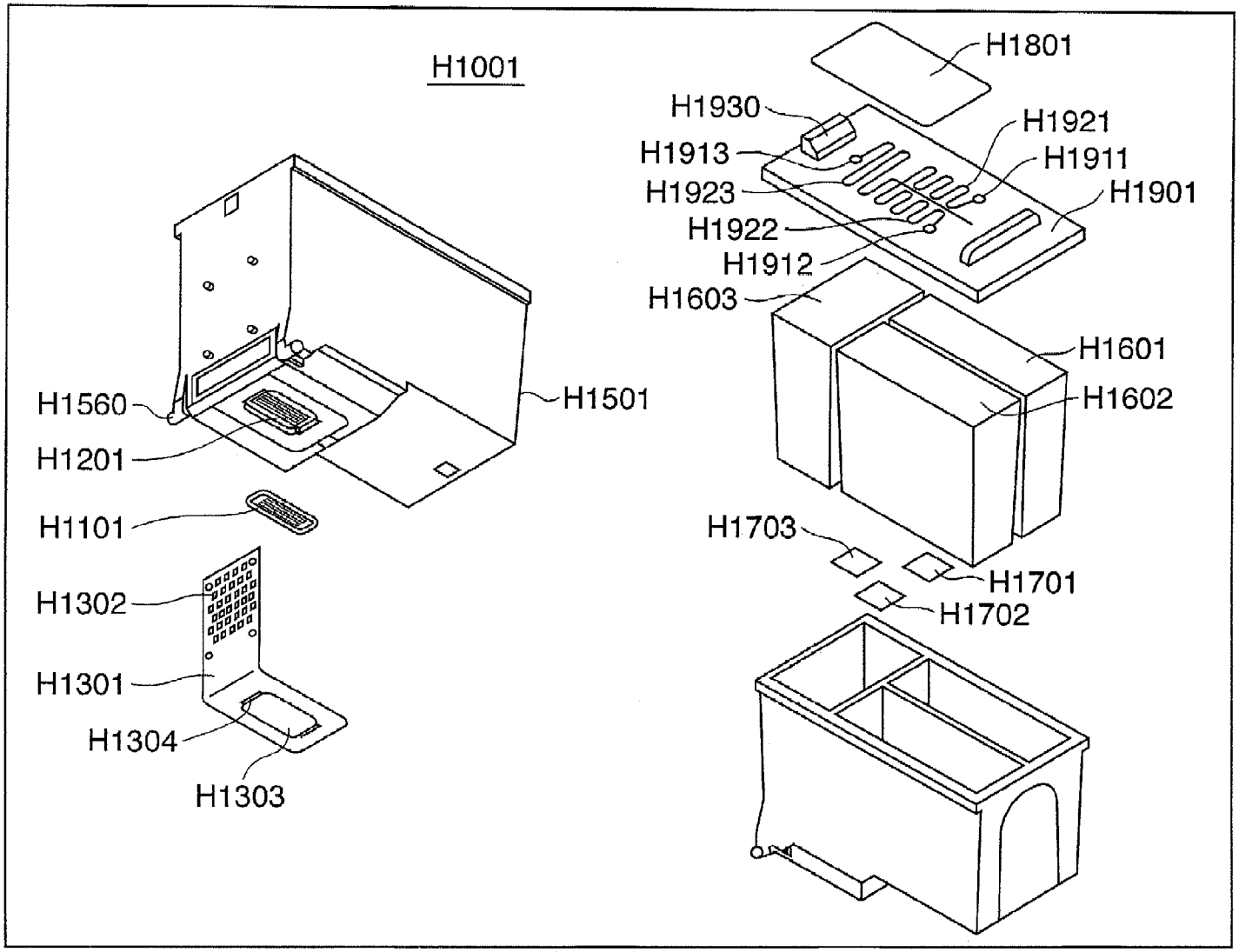
FIG. 7 is an exploded perspective view of the printhead cartridge H1001.

FIG. 7 is an exploded perspective view of the printhead cartridge H1001. The printhead cartridge H1001 discharge inks of three colors, i.e., cyan, magenta, and yellow. As shown in FIG. 7, the printhead cartridge H1001 includes a printhead H1101, electric wiring tape H1301, ink supply holding member H1501, filters H1701 to H1703, ink absorbers H1601 to H1603, lid member H1901, and seal member H1801.

Printhead H1101

Figure 8:
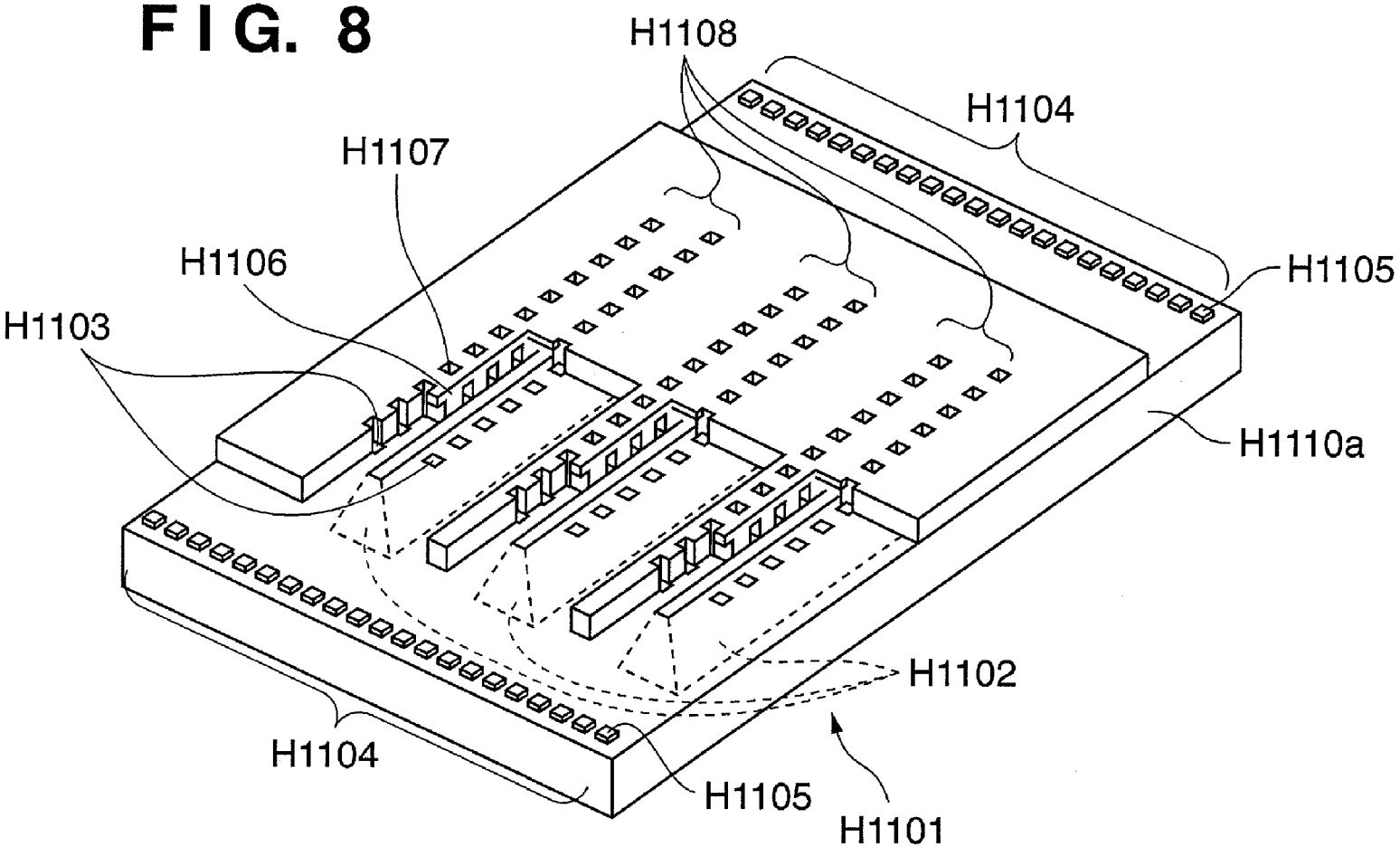
FIG. 8 is a partially cutaway perspective view for explaining the structure of a printhead H1101.

FIG. 8 is a partially cutaway perspective view for explaining the structure of the printhead H1101. The printhead H1101 significantly differs from the printhead H1100 in that three ink supply ports H1102 for cyan, magenta, and yellow are juxtaposed. Arrays of the electrothermal transducers H1103 and orifices H1107 are arranged in a staggered pattern on both sides of each ink supply port H1102. A head substrate HlllOa has electric wirings, fuse ROMs, resistances, and electrodes, like the head substrate H1110 of the printhead H1100. The ink channel wall H1106 made of resin material and the orifices H1107 are formed on the head substrate H1110*a* by photolithography. Each electrode H1104 to supply power to the electric wirings has the bump H1105 made of, e.g., Au.

In this embodiment, the ink orifices are arranged in a staggered pattern. Instead, the ink orifices may be arranged on both sides of an ink supply port while facing each other.

Electric Wiring Tape H1301

The electric wiring tape H1301 basically has the same structure as the electric wiring tape H1300, and a description thereof will be omitted.

Ink Supply Holding Member H1501

The ink supply holding member H1501 basically has the same structure and function as the ink supply holding member H1500, and a description thereof will be omitted. The ink supply holding member H1501 has three independent spaces to hold three color inks. The spaces store the ink absorbers H1601 to H1603. The three ink supply ports H1201 provided on the bottom of the ink supply holding member H1501 communicate with the ink supply ports H1102 (see FIG. 8) after assembly.

Lid Member H1901

The lid member H1901 has the same structure as the lid member H1900. The lid member H1901 has fine ports H1911 to H1913 to let a pressure variation in the spaces of ink supply holding member H1501 relax and fine grooves H1921 to H1923 communicating with the fine ports H1911 to H1913.

Attachment of the above-described printheads to the inkjet printing apparatus will be described next in detail.

As shown in FIGS. 3 and 6, each of the printhead cartridges H1000 and H1001 has an attachment guide H1560 to guide the printhead cartridge to the attachment position of the carriage 102 of the printing apparatus, the engaging portion H1930 to attach and fix the printhead cartridge to the carriage by a head set lever, and an X-direction (main scanning direction) butt portion H1570, Y-direction (sub-scanning direction) butt portion H1580, and Z-direction (ink discharge direction) butt portion H1590 to position the printhead cartridge to a predetermined attachment position of the carriage. These butt portions position the printhead cartridge to ensure accurate electrical contact between the external signal input terminals H1302 on the electric wiring tapes H1300 and H1301 and the contact pins of the electrical connection portions provided in the carriage.

<Structure of Contact Pads (FIGS. 9 and 10)>

Printhead Cartridge H1001

Figure 9:
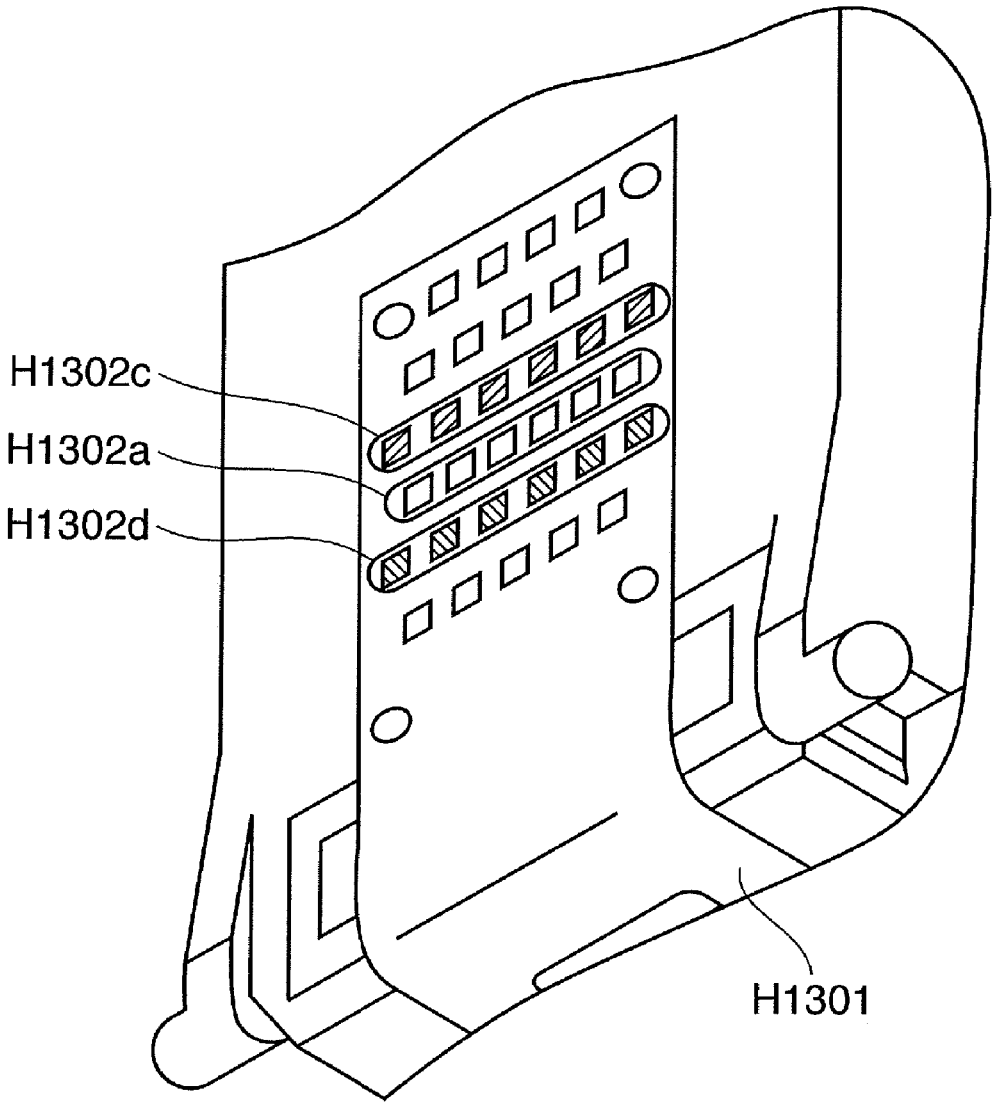
FIG. 9 is an enlarged view of the external signal input terminal portion of an electric wiring tape H1301 of the printhead cartridge H1001.

FIG. 9 is an enlarged view of the external signal input terminal portion of the electric wiring tape H1301 of the printhead cartridge H1001. Referring to FIG. 9, the electric wiring tape H1301 has 32 external signal input terminals H1302. The external signal input terminals H1302 include six ID contact pads H1302*a* which are located almost at the center of the area where the external signal input terminals H1302 are provided. The ID contact pads H1302*a* connect to some of the electrodes H1104 that exist at the two ends of each of the three ink supply ports H1102 of the printhead H1101 shown in FIG. 8.

Six VH contact pads H1302*c* are arranged adjacent to one side (upper side in FIG. 9) of the array of the ID contact pads H1302*a* while being arrayed along them. The VH contact pads H1302*c* connect to some of the electrode pads H1104 at the two ends of the printhead H1101 shown in FIG. 8.

Six GNDH contact pads H1302*d* are arranged adjacent to the other side (lower side in FIG. 9) of the array of the ID contact pads H1302*a* while being arrayed along them. The GNDH contact pads H1302*d* connect to some of the electrode pads H1104 at the two ends of the printhead H1101 shown in FIG. 8.

The remaining external signal input terminals H1302 except the ID contact pads H1302*a*, VH contact pads H1302*c*, and GNDH contact pads H1302*d* are used to supply power for transistors and other signals such as a control signal.

In the printhead cartridge H1001, the ID contact pads H1302*a* relatively sensitive to static electricity are located almost at the center of the external signal input terminals H1302. With this layout, the user who is holding the printhead cartridge H1001 hardly touches the ID contact pads H1302*a*. The user basically holds a printhead while taking precaution not to touch the external signal input terminals H1302. Hence, it is difficult to touch the pads located at the center.

Additionally, the ID contact pads H1302*a* are adjacent to the VH contact pads H1302*c* and GNDH contact pads H1302*d* and are sandwiched between them. If a user puts his/her charged finger nearby the ID contact pads H1302*a* and causes discharge, the discharge readily occurs in the VH contact pads H1302*c* and GNDH contact pads H1302*d*. This structure can therefore almost prevent head specific information from being destroyed or accidentally rewritten by the discharge.

Printhead Cartridge H1000

Figure 10:
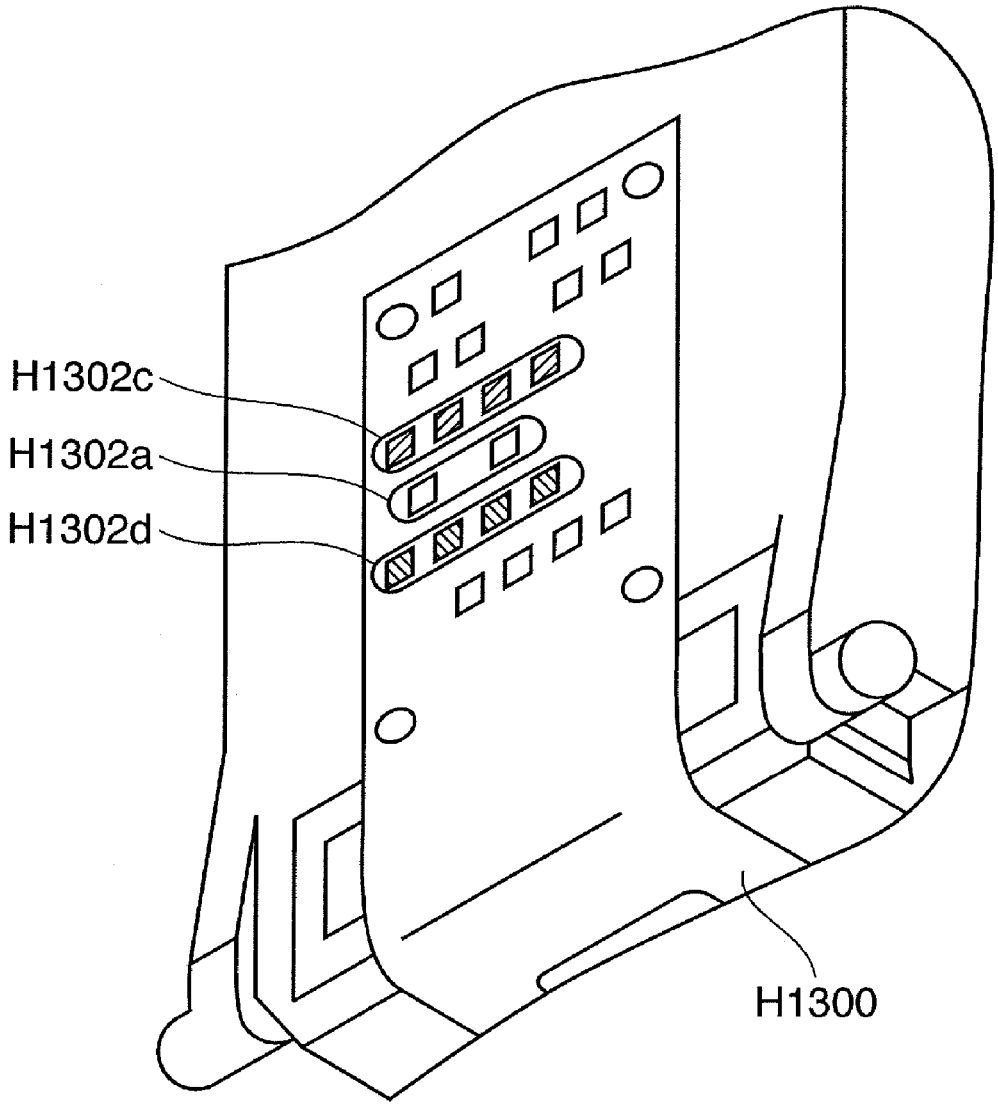
FIG. 10 is an enlarged view of the external signal input terminal portion of an electric wiring tape H1300 of the printhead cartridge H1000.

FIG. 10 is an enlarged view of the external signal input terminal portion of the electric wiring tape H1300 of the printhead cartridge H1000. Referring to FIG. 10, the electric wiring tape H1300 has 21 external signal input terminals H1302. Since the printhead cartridge H1000 is a black ink cartridge, the number of terminals for power supply and control signal is smaller than in the above-described printhead cartridge H1001 for inks of three colors, i.e., cyan, magenta, and yellow. The carriage 102 of the printing apparatus main body is designed such that a photo printhead having the same form as the printhead cartridge H1001 is attachable in place of the printhead cartridge H1000. For this reason, the positions of the 21 external signal input terminals H1302 of the printhead cartridge H1000 correspond to the positions of the external signal input terminals H1302 of the printhead cartridge H1001.

The external signal input terminals H1302 provided on the electric wiring tape H1300 include six ID contact pads H1302*a* which are located almost at the center of the area where the external signal input terminals H1302 are provided. The ID contact pads H1302*a* connect to some of the electrode pads H1104 that exist at the two ends of the ink supply port H1102 of the head substrate H1100 shown in FIG. 5.

Four VH contact pads H1302*c* are arranged adjacent to one side (upper side in FIG. 10) of the array of the ID contact pads H1302*a* while being arrayed along them. The VH contact pads H1302*c* connect to some of the electrode pads H1104 at the two ends of the head substrate H1100 shown in FIG. 5.

Four GNDH contact pads H1302*d* are arranged adjacent to the other side (lower side in FIG. 10) of the array of the ID contact pads H1302*a* while being arrayed along them. The GNDH contact pads H1302*d* connect to some of the electrode pads H1104 at the two ends of the head substrate H1100 shown in FIG. 5.

The remaining external signal input terminals H1302 except the ID contact pads H1302*a*, VH contact pads H1302*c*, and GNDH contact pads H1302*d* are used to supply power for transistors and other signals such as a control signal.

Even in the printhead cartridge H1000, the ID contact pads H1302*a* relatively sensitive to static electricity are located almost at the center of the external signal input terminals H1302, like the printhead cartridge H1001. With this layout, the user who is holding the printhead cartridge H1000 hardly touches the ID contact pads H1302*a*.

Additionally, the ID contact pads H1302*a* are adjacent to the VH contact pads H1302*c* and GNDH contact pads H1302*d* and are sandwiched between them. If a user puts his/her charged finger nearby the ID contact pads H1302*a* and causes discharge, this structure can almost prevent head specific information from being destroyed or accidentally rewritten by the discharge.

Several embodiments of the structure of the head substrate applied to the printing apparatus and printhead having the above-described arrangements will be described next.

FIRST EMBODIMENT

Figure 11:
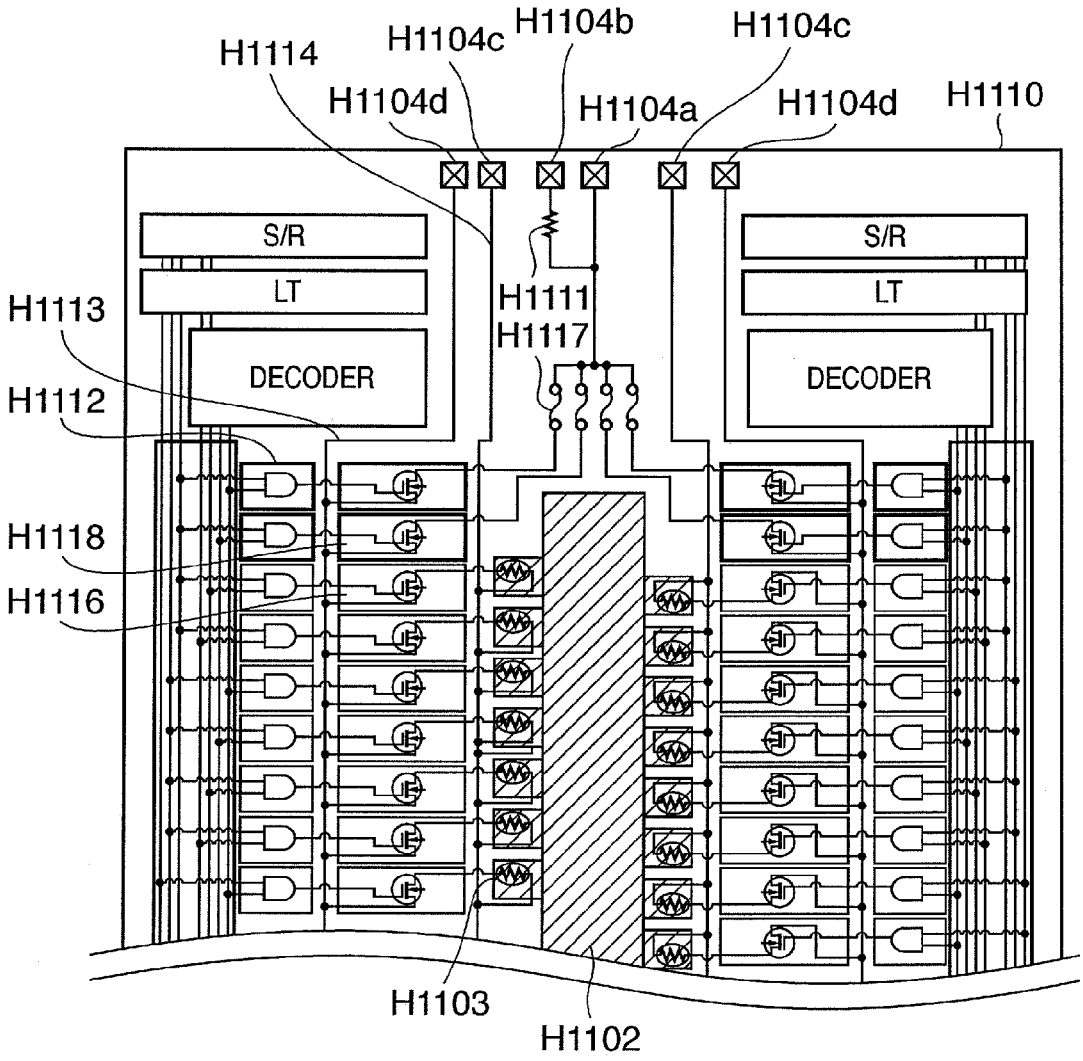
FIG. 11 is a view showing the circuit arrangement and layout of the main part of a head substrate according to the first embodiment.

FIG. 11 is a view showing the circuit arrangement and layout of the main part of a head substrate according to the first embodiment. A printhead H1100 has a head substrate H1110 having semiconductor elements and wirings formed, by a semiconductor process, on a base made of silicon (Si).

As shown in FIG. 11, the head substrate H1110 has fuse ROMs to store information unique to the head and necessary peripheral circuits.

Referring to FIG. 11, an elongated ink supply port H1102 is formed in the silicon base. The elongated ink supply port can be of a rectangular, oblong, or elliptic shape. The ink supply port need only be an elongated opening capable of supply ink in the longitudinal direction of the substrate.

Electrothermal transducers H1103 such as resistors that form printing elements are arrayed on both sides of the ink supply port. In FIG. 11, the electrothermal transducers H1103 on both sides of the ink supply port are arranged in a staggered pattern. However, they may be located without shift or need not always be arranged linearly.

Driving elements H1116 to drive the electrothermal transducers H1103 are arrayed at positions spaced apart further away from the ink supply port than the electrothermal transducers. Signal lines that supply signals to selectively drive the electrothermal transducers are arranged closer to the end (an end of the long side of the substrate) of the substrate than the arrangement region of the driving elements H1116.

Reference numeral H1117 denotes a fuse ROM. In this example, four fuse ROMs H1117 each including a polysilicon resistor are arranged in the space on the extension of the ink supply port H1102. It is difficult to provide the circuits and wirings to drive the electrothermal transducers in an area near the ink supply port on its extension while avoiding the ink supply port. This area having neither circuits nor wirings is usable to arrange the fuses close to each other while achieving space-saving.

In this embodiment, the fuse employs a polysilicon resistor. Instead, the fuse may employ a metal film such as Al or a resistor. A fuse including a resistor is more preferable if it can be formed in the same film formation step as the electrothermal transducer by using the same material as the electrothermal transducer to discharge ink.

Each fuse ROM H1117 connects to a driving element H1118 to melt the fuse and read out information from it. The driving elements H1118 are arranged on both sides of the extension of the ink supply port at positions adjacent to the other driving elements H1116 to drive the electrothermal transducers H1103.

In this embodiment, signal lines to supply a signal to select the driving elements H1116 to drive the electrothermal transducers H1103 to apply heat to ink are used as signal lines to supply a signal to select the driving elements H1118 to drive the fuse ROMs H1117. In this embodiment, the block enable signal lines to select the electrothermal transducers are shared to select fuses to be melted or accessed to read out information.

Since the signal lines running along the long side end of the head substrate are shared, the driving elements H1118 to drive the fuses have the same structure as the driving elements H1116 to drive the electrothermal transducers and exist on the same arrays. The fuse ROMs H1117 to be driven by the driving elements H1118 arranged on both sides of the extension of the ink supply port are arranged in the intermediate region sandwiched between the extensions of the array directions of the driving elements H1118. This enables to extract the ID terminal commonly connected to the fuses included in the fuse ROMs from a short side of the head substrate. Hence, the driving elements, fuse ROMs, and ID wirings can be arranged efficiently.

In this embodiment, a portion from a signal line (no electrode pad is illustrated) to receive a signal from the outside of the head substrate to a signal line connected to the driving element H1118 through a shift register (S/R), latch circuit (LT), and decoder (DECODER) serves as a circuit to select a specific fuse to melt it or read out a signal from it and has the same circuit arrangement as the circuit to select the driving element H1116. A selection circuit (AND circuit) H1112 to finally select the driving element H1118 on the basis. of the output from the shift register has the same structure as the selection circuit (AND circuit) for the driving element H1116.

Each VH pad 1104*c* to supply VH power connects to the electrothermal transducers H1103 through a VH wiring H1114. Each GNDH pad H1104*d* to supply GNDH power commonly connects to the driving elements H1116 connected to the electrothermal transducers H1103 and the driving elements H1118 connected to the fuse ROMs H1117 through a GNDH wiring H1113. That is, the driving elements H1116 and H1118 share the GNDH wirings H1113.

As described above, in this embodiment, a circuit having the same arrangement as the circuit to select the driving element H1116, including a signal line to transfer a selection signal of the driving element H1116, a decoder (DECODER) to generate a time-division selection signal (BLE), a latch circuit (LT) and shift register (S/R) including the other signals, and a signal input pad (not shown) from the outside of the head substrate, is used to select a fuse ROM. This makes is possible to select the driving element H1118 to drive the fuse ROM H1117 without adding any new signal line, wiring region, and circuit.

An ID pad H1104*a* functions as a fuse melting power supply terminal to apply a voltage when melting the fuse ROM H1117 and as a signal output terminal when reading out information from the fuse ROM. More specifically, to melt the fuse ROM H1117, a fusing voltage (e.g., a relatively high voltage equal to the driving voltage (24 V) of the electrothermal transducer) is applied to the ID pad H1104*a* to drive the driving element H1118 selected by the selection circuit and instantaneously melt the corresponding fuse ROM H1117. At this time, an ID power supply pad H1104*b* serving as a fuse read power supply terminal has no influence on the internal circuit of the printing apparatus main body. On the other hand, to read out information, a read voltage (e.g., a relatively low voltage equal to the power supply voltage (3.3 V) of the logic circuit) is applied to the ID power supply pad H1104*b*. If the fuse ROM H1117 is open, a high-level (H) signal is output to the ID pad H1104*a*. If the fuse ROM H1117 is not open, a low-level (L) signal is output to the ID pad H1104*a* because of a read resistance H1111 obviously larger than the resistance value of the fuse ROM H1117.

The following three points are characteristic of the terminal portion structure in melting a fuse and that in reading out information from a fuse.

(1) The ID pad H1104*a* is provided as a terminal to melt the fuse ROM H1117.

(2) The ID power supply pad H1104*b* is provided as a power supply terminal to read out information based on the presence/absence of melting.

(3) The read resistance H1111 much higher than the fuse resistance is connected between the fuse read power supply terminal H1104*b* and the fuse ROM H1117 to output a low-level (L) signal if the fuse ROM is not open.

As is apparent from the above description, the driving elements H1116 and the like are designed to melt a fuse ROM by applying a voltage (e.g., 24 V) to drive the electrothermal transducers. Hence, the conventional power supply arrangement is usable to melt the fuse ROM without adding any new power supply on the printing apparatus side. Similarly, use of the power supply voltage of the logic circuit normally used in the head substrate allows to design the fuse ROM H1117 that does not damage any elements on the head substrate upon reading without adding any new power supply on the printing apparatus side. The printing apparatus side can receive a signal from the fuse ROM H1117 by using an existing circuit.

However, the power supply voltage (e.g., 3.3 V) of the logic circuit is much lower than the fusing voltage to melt the fuse, which equals the voltage (e.g., 24 V) to drive the electrothermal transducers H1103. For this reason, it is impossible to drive the driving elements H1118 directly from the AND circuits H1112 to input the selection signal to select a fuse ROM.

Figure 12:
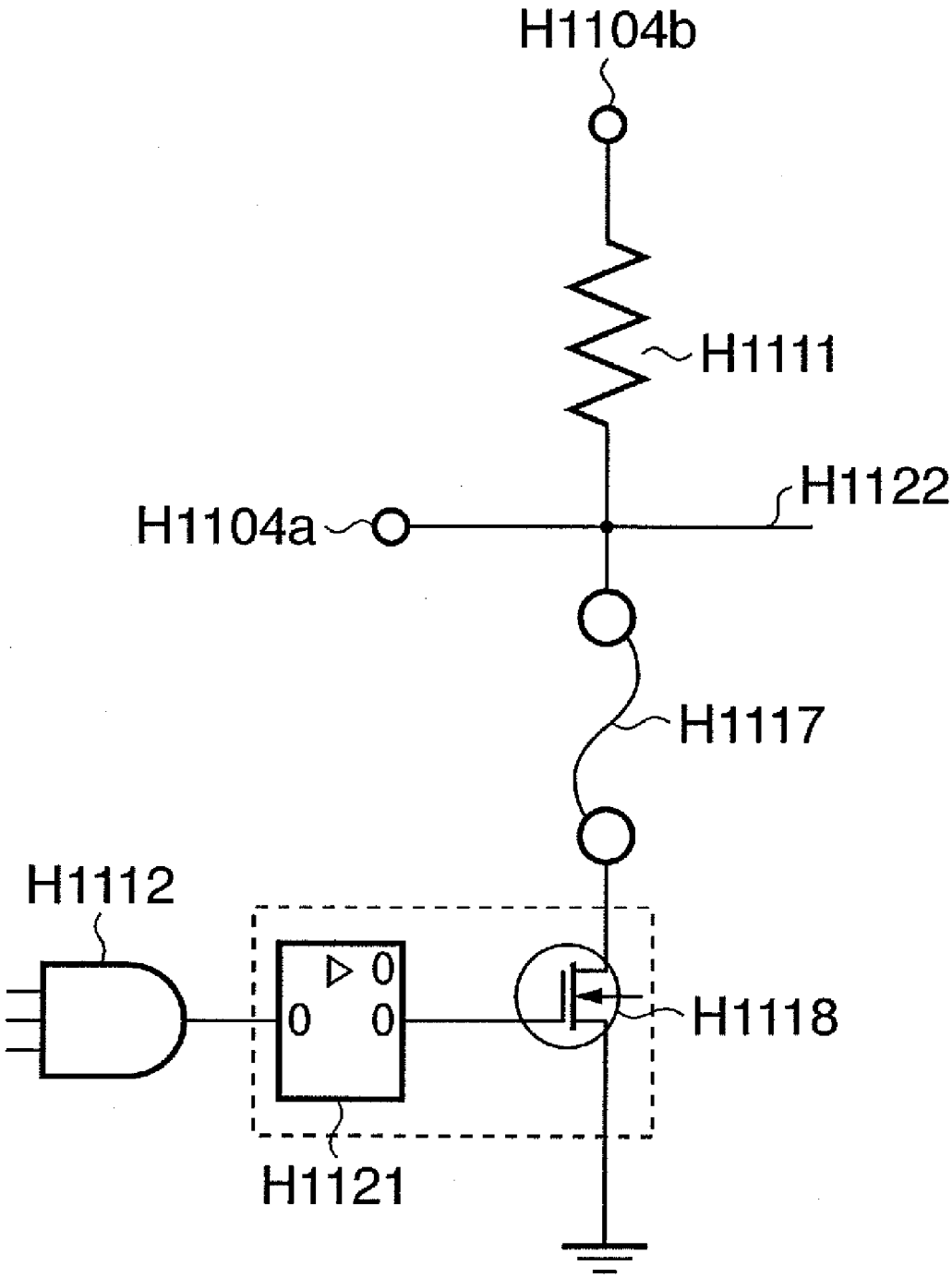
FIG. 12 is a view showing an equivalent circuit for driving a fuse ROM corresponding to one element to store information.

FIG. 12 is a view showing an equivalent circuit for driving a fuse ROM corresponding to one element (one bit) to store information.

As shown in FIG. 12, this embodiment comprises a boosting circuit H1121 of a selection signal corresponding to each driving element. That is, the boosting circuit H1121 boosts the output signal voltage (e.g., 3.3 V) from the AND circuit H1112 to give the selection signal of the driving element H1116 or H1118 to the intermediate voltage (e.g., 16 V).

This also applies to the driving element H1116 to drive the electrothermal transducer H1103. The driving element H1116 also incorporates the boosting circuit H1121 with the same structure as described above. The intermediate power supply voltage used by the selection signal boosting circuit H1121 is generated in the head substrate from the driving power supply voltage (e.g., 24 V) of the electrothermal transducer H1103. The boosting circuit H1121 of the selection signal to select the driving element H1116 also uses the same power supply (not shown) in the head substrate.

To reliably melt the fuse ROM H1117, it is necessary to uniformly apply a sufficient energy to the fuse ROMs H1117. For this purpose, it is necessary to equalize and reduce parasitic resistances except the fuse ROMs H1117 to sufficiently increase and equalize the voltages to be applied to the fuse ROMs H1117. In the head substrate, basically, the resistance values of the power supply wirings to the electrothermal transducers H1103 are reduced to minimize the variation so as to control the energy to be applied to the electrothermal transducers H1103.

In this embodiment, the driving elements H1116 connected to the electrothermal transducers H1103 and the driving elements H1118 connected to the fuse ROMs H1117 share the power supply wirings H1113 on the GND side to sufficiently increase and equalize the voltages to be applied to the fuse ROMs H1117 and also prevent any increase in the head substrate size due to an increase in the number of wirings.

The fuse ROMs H1117 arrayed in the vicinity share the power supply wiring on the opposite side to the power supply wirings connected to the driving elements H1118 of the fuse ROMs H1117. This enables to stably melt the fuse ROM H1117 without newly forming a plurality of wirings with equalized resistance values. The fuse ROMs H1117 need not have the read resistance H1111 separately and can share it through an wiring H1122.

The boosting circuit H1121 of the selection signal to select the driving element H1118 connects to the AND circuit H1112 to input the selection signal which is selected from a plurality of signals including a time-division selection signal (BLE). The AND circuit H1112 to input the selection signal also has the same structure as that used for the driving element H1116.

Figure 13:
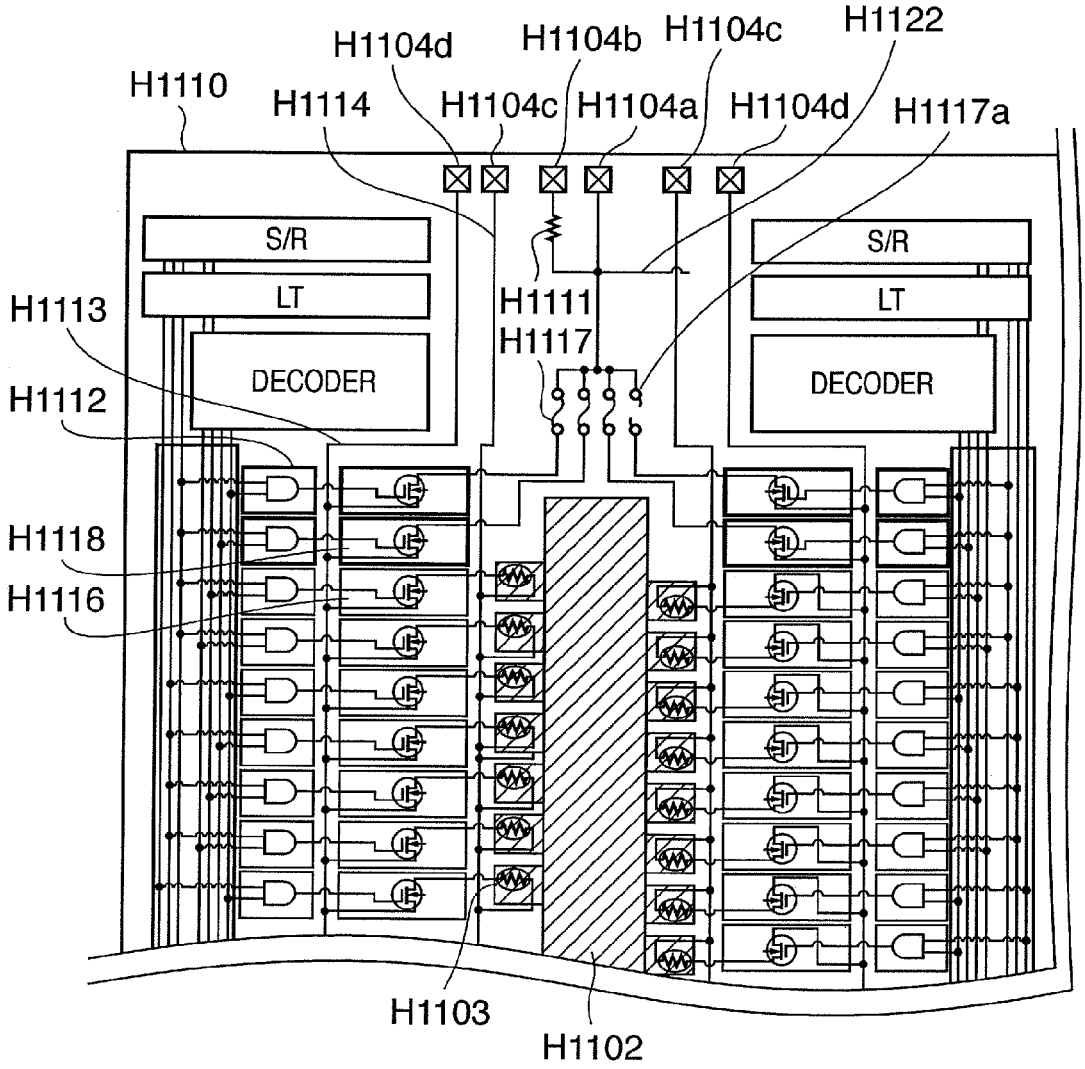
FIG. 13 is a view showing the layout of a head substrate H1110 having the same circuit arrangement as in FIG. 11 in which one fuse ROM H1117*a* of four fuse ROMs H1117 is melted.

FIG. 13 is a view showing the layout of the head substrate H1110 having the same arrangement as in FIG. 11. FIG. 13 shows a state where one fuse ROM H1117*a* of the four fuse ROMs H1117 is melted.

As described above, a fuse is melted by using the same voltage as that in driving the electrothermal transducers. Hence, the driving elements H1118 to drive the fuse ROMs must have the same tolerance as that required of the driving elements H1116 to drive the electrothermal transducers.

In this embodiment, the driving elements H1118 are formed by the same processes as those for the driving elements H1116 to drive the electrothermal transducers H1103. Hence, driving elements with the necessary tolerance are formed in the conventional manufacturing process without adding any special process.

As described above, in this embodiment, the arrangement on the input side of the signal lines to transfer a selection signal to select a fuse ROM also serves as the driving arrangement of the electrothermal transducers. The circuit arrangement including the AND circuits H1112 to input a selection signal to the driving elements H1118 of the fuse ROMs H1117 is also the same as the circuit to drive the electrothermal transducers H1103.

Hence, as shown in FIGS. 11 and 13, the driving elements H1118 that are driven to melt or read-access the fuse ROMs H1117 can be arranged adjacent to the driving elements H1116 at the outermost ends in the driving element array direction.

The signal lines and power supply lines (the power supply lines of the AND circuits and the wirings to supply the intermediate voltage for the driving elements) necessary for the circuit for the fuse ROMs H1117 also have the same layout as the circuit for the electrothermal transducers H1103. With the layout as shown in FIGS. 11 and 13, it is unnecessary to newly add signal lines and the above-described power supply lines. There is no influence on the layout of signal lines related to the electrothermal transducers H1103.

In addition, troublesome wirings to avoid the ink supply port H1102 formed in the head substrate is unnecessary, and no space is wasted. Making the circuit to select and drive the fuse ROMs H1117 and the circuit to select and drive the electrothermal transducers H1103 have the same structure contributes to suppressing any increase in the head substrate size. When identical arrangements exist on both side of the ink supply port H1102, the space on the head substrate can effectively be used.

The fuse ROM H1117 stores in formation by melting. Hence, it is impossible to place a logic circuit or wiring on or under the fuse ROM. The power supply wirings of the electrothermal transducers H1103 are laid out on the extensions of the arrays of the driving elements H1116 and H1118.

To maintain the image formation performance of the arrangement of this embodiment, it is very important to apply equal energies to all the electrothermal transducers H1103.

To do this, it is necessary to equalize the resistance values of the power supply wirings of the electrothermal transducers H1103 as much as possible. The power supply wirings require a large area on the substrate to reduce the resistance values and suppress energy loss by the wirings. It is therefore difficult to bypass the power supply wirings of the electrothermal transducers H1103 in accordance with the layout of the fuse ROMs H1117.

When the driving elements H1118 are arranged adjacent to the driving elements H1116 at the outermost ends, and the fuse ROMs H1117 are arranged inside the arrays of the driving elements H1116 and H1118 (on the side of the ink supply port H1102), a layout that does not interfere with the power supply wirings of the electrothermal transducers H1103 is obtained. As a result, the space on the head substrate can effectively be used without interfering with the layout of signal lines to transfer a selection signal.

In this embodiment, the fuse ROMs H1117 include polysilicon resistors. A thick film of an organic material used for forming the orifices covers the upper surfaces of the fuse ROMs H1117 so as to increase the reliability. The thick film between the fuses and the ink supply port is partially removed to prevent any permeation from the supply port to the structure between the thick film and the head substrate from influencing the fuses.

The actual procedure of selectively melting a fuse ROM (i.e., writing information) and reading out the information will be described in detail with reference to FIGS. 14 and 15.

Figure 14:
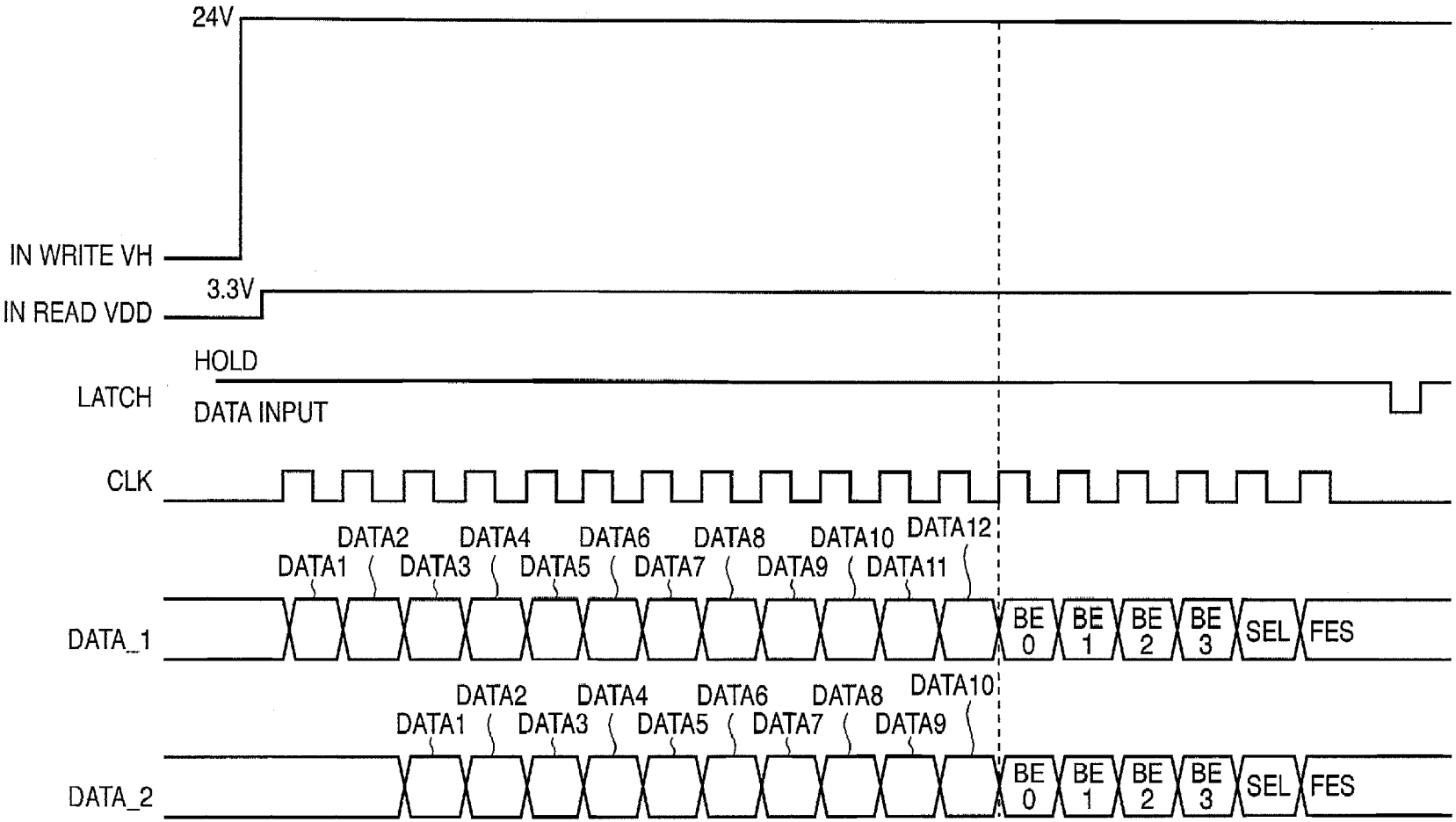
FIG. 14 is a timing chart of signals related to information input/output to/from a fuse ROM.

FIG. 14 is a timing chart of signals related to information input/output to/from a fuse ROM.

Referring to FIG. 14, DATA_1 indicates a serial signal input to the printhead cartridge H1000 to discharge black ink for monochrome print. DATA_2 indicates a serial signal input to the printhead H1001 to discharge three color inks for color print. Since the number of orifices to discharge ink changes between the printheads, the amount of data transferred to the printhead per cycle of printing operation also changes between them. To commonly control the printheads, the printing apparatus inputs, to the two printheads, block selection signals (BE0 to BE3) following the data signal (DATA) at the same timing.

Figure 15:
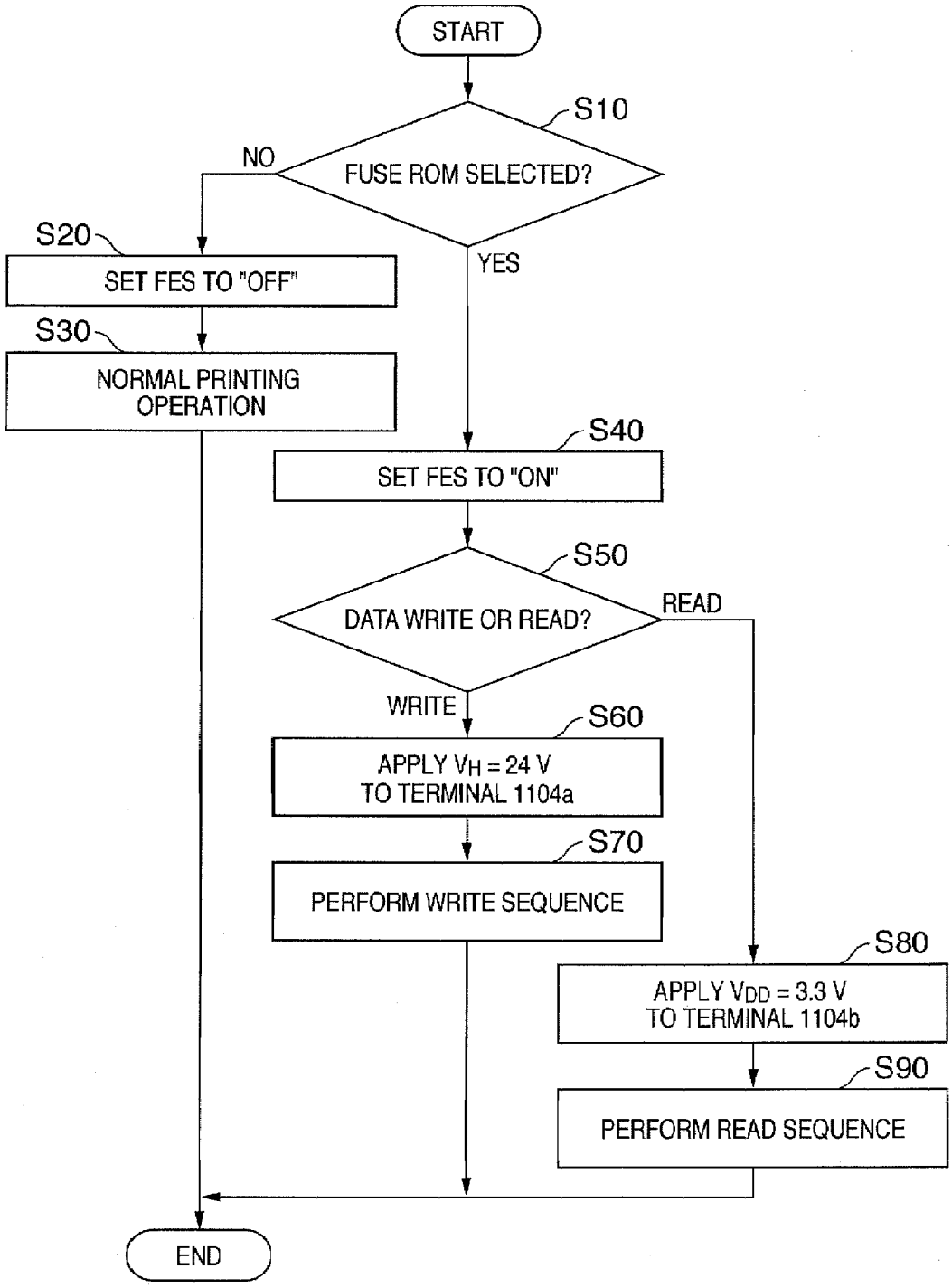
FIG. 15 is a flowchart showing information input/output processing to/from a fuse ROM.

FIG. 15 is a flowchart showing information input/output processing to/from a fuse ROM. The control circuit of the printing apparatus executes this processing independently or in cooperation with a host computer connected to the printing apparatus.

In step S10, it is checked whether or not the head substrate is driven to select a fuse ROM. If NO in step S10, the processing advances to step S20 to set to "OFF" a fuse enable selection signal (FES) that is serially transmitted to a printhead together with the data signal (DATA) and block selection signals (BE0 to BE3), as shown in. FIG. 14. The processing advances to step S30. In step S30, the printheads are driven to execute normal printing operation.

The fuse enable selection signal (FES) is also supplied to the electrothermal transducers that are arranged at ends of the electrothermal transducer arrays and not driven in printing. The fuses and the electrothermal transducers that are not driven in printing are selectively driven by a selection signal output from the decoder.

If YES in step S10, the processing advances to step S40 to set the fuse enable selection signal (FES) to "ON". In step S50, it is further checked whether the fuse ROM selection operation is a data write operation or data read operation. If it is determined that the current operation is a data write operation, the processing advances to step S60.

In step S60, prior to the data write operation (i.e., fuse ROM melting), the power supply voltage ($V_H$) of the electrothermal transducers H1103, e.g., 24 V is applied to the ID pad H1104*a* serving as a fuse rapture power supply terminal. In addition, the GND-side GNDH pad H1104*d* corresponding to the fuse ROM H1117 to be melted is set to 0 V. Since the power supply voltage ($V_H$) of the electrothermal transducers H1103 is also applied to the fuse read power supply terminal H1104*b* at this time, the printing apparatus side must take a measure.

The processing advances to step S70 to execute a data write sequence. As shown in FIG. 14, like upon selecting the driving elements H1116 of the electrothermal transducers H1103, the data signal (DATA) and block selection signals (BE0 to BE3) are serially input to the shift register (S/R) in synchronism with a clock signal (CLK) input from an input pad H1104*f*. After the data signal (DATA) is input, a latch signal (LATCH) is input from an input pad H1104*h* to cause a latch circuit (LT) to latch the data signal and convert the received serial signal into parallel signals. Note that dummy data irrelevant to actual printing is set in the data signal when selectively driving a fuse ROM.

These signals enter from the latch circuit (LT) directly to the AND circuit H1112, and some of them enter the AND circuit H1112 as the time-division selection signal (BLE) through the decoder (DECODER), as is apparent from the arrangement shown in FIGS. 11 and 13. Then, an enable signal (ENB) is input from an input pad H1104*e* to drive the driving element H1118 of a fuse ROM. The selected fuse ROM H1117 is melted so that, e.g., the state of the fuse ROM H1117*a* shown in FIG. 13 is obtained.

Then, the processing is complete.

On the other hand, if it is determined in step S50 that the current operation is a data read operation, the processing advances to step S80.

In step S80, prior to the data read operation, the power supply voltage ($V_{DD}$) of the logic circuit, e.g., 3.3 V is applied to the fuse read power supply terminal H1104*b*. In addition, the GND-side GNDH pad H1104*d* corresponding to the fuse ROM H1117 to be read-accessed is set to 0 V.

The processing advances to step S90 to execute a data read sequence.

If the fuse H1117 is not open, a current flows to the fuse H1117 through the read resistance H1111 upon inputting a signal, like in melting, during supply of the driving signal. The read resistance H1111 has a sufficiently high resistance value with respect to the fuse ROM H1117. Hence, the voltage of the ID pad H1104*a* decreases to almost 0 V due to voltage division by the resistance so that a low-level (L) signal is output to the printing apparatus. To the contrary, if the fuse ROM H1117 is open, like the fuse H1117*a*, no current flows to the fuse ROM H1117*a*. Hence, the voltage of the ID pad H1104*a* is close to the power supply voltage, e.g., 3.3 V so that a high-level (H) signal is output to the printing apparatus. Then, the processing is complete.

With the above-described processing, the voltage to be applied to the fuse ROM changes between the write and the read of information. Hence, head information is stored in the fuse ROM and read out from the fuse ROM.

The printhead H1101 basically has the same arrangement as described above.

According to the above-described embodiment, the logic circuit arrangement is partially shared for writing/reading information in/from a fuse ROM. In addition, the fuse ROMs are arranged by using the space between the logic circuits. This allows to provide a head substrate having fuse ROMs serving as storage elements without increasing the head substrate size and also input/output information by switching the voltage to be applied to the fuse ROMs.

According to this embodiment, the following advantages are also achieved.

The electrothermal transducers H1103 are basically very sensitive to excess energy application. Commercialization of the printhead is realized with paying close attention for transmission of block selection signals (BE0 to BE3) and the enable signal (ENB) for determining the ON time of the driving elements H1116 from the printing apparatus side. The signal transfer system has a very high safety and reliability.

The arrangement in which the fuse ROMs are arranged as described above, and the logic circuit to drive the electrothermal transducers is partially shared with writing/reading information in/from a fuse ROM that might cause an information write error upon accidental excess energy application ox cannot erase information once it is written is advantageous in view of ensuring the safety and reliability, like driving the electrothermal transducers.

<First Modification>

The arrangement on the input side of the signal lines to transfer a selection signal is shared by the driving elements of the electrothermal transducers. The layout of the driving elements to drive the fuse ROMs and the AND circuits to select the driving elements has several modifications.

Figure 16:
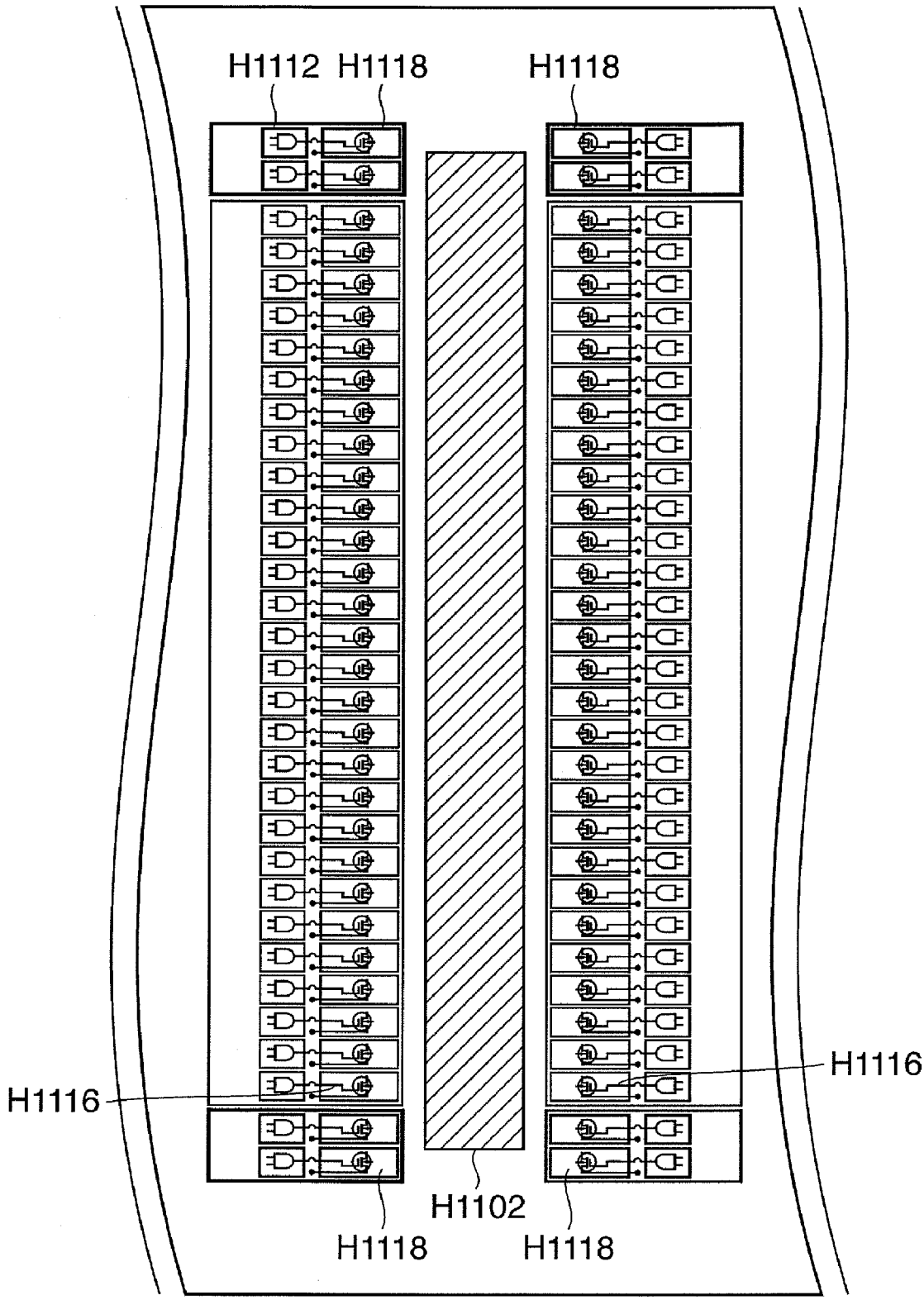
FIGS. 16 and 17 are views showing modifications of the layout of driving elements to drive fuse ROMs and AND circuits to select the driving elements.
Figure 17:
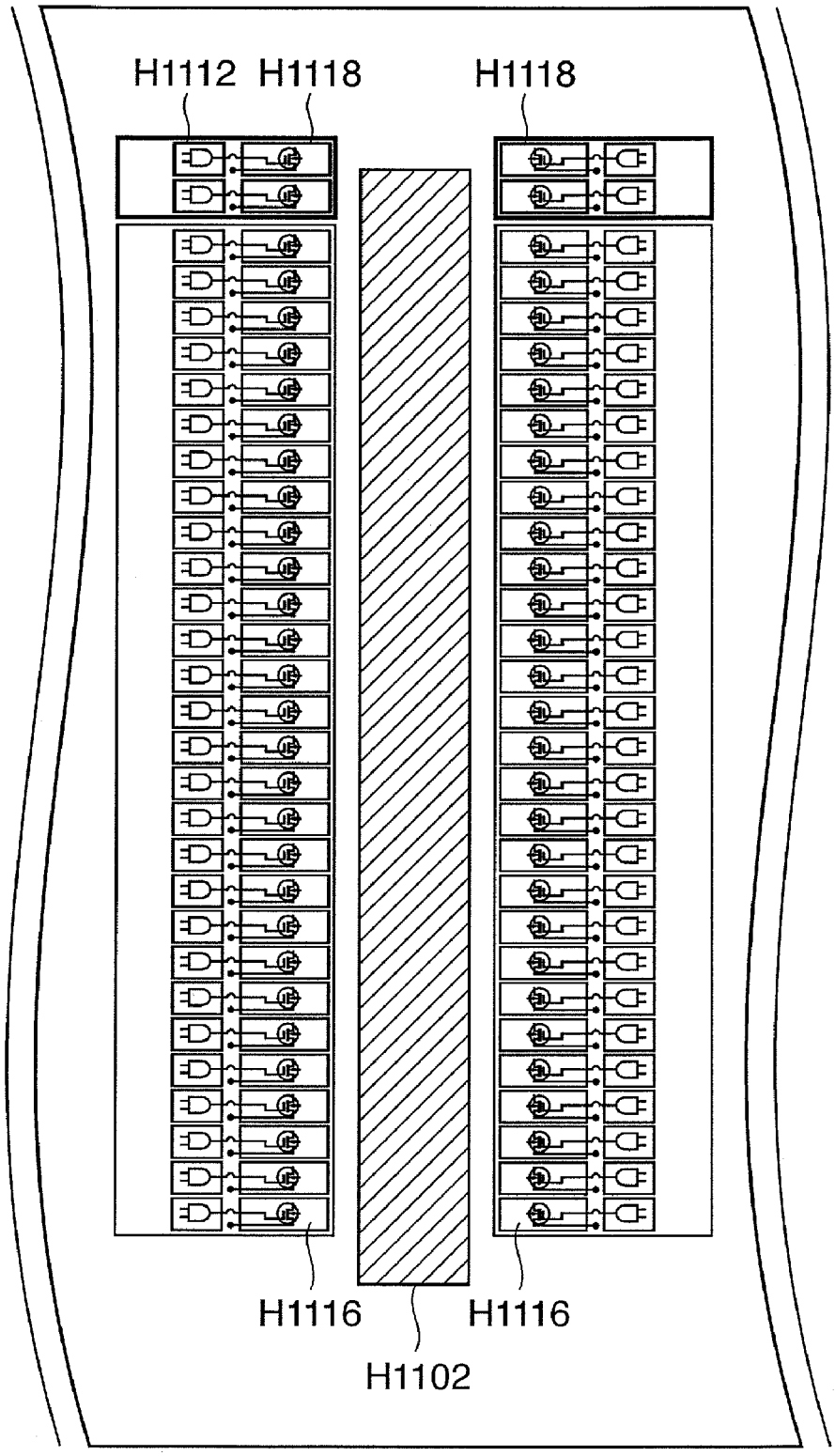

FIGS. 16 and 17 are views showing modifications of the layout of the driving elements to drive the fuse ROMs and the AND circuits to select the driving elements.

As shown in FIG. 16, the driving elements H1118 may be arranged adjacent to both sides of each of the arrays of the driving elements H1116 on both sides of the ink supply port H1102. Alternatively, as shown in FIG. 17, the driving elements H1118 may be arranged adjacent to only one side of each of the arrays of the driving elements H1116 on both sides of the ink supply port H1102.

An efficient layout is possible in both FIGS. 16 and 17.

<Second Modification>

A modification of the layout of fuse ROMs will be described.

According to the layout shown in FIG. 11 or 13, the driving elements H1118 to drive the fuse ROMs H1117 are originally elements to drive the electrothermal transducers H1103. There are only wirings in a space adjacent to the driving elements H1118 where electrothermal transducers are supposed to be formed. From the viewpoint of efficient utilization of the space on the head substrate, the fuse ROMs may be formed in the space with only the wirings.

Figure 18:
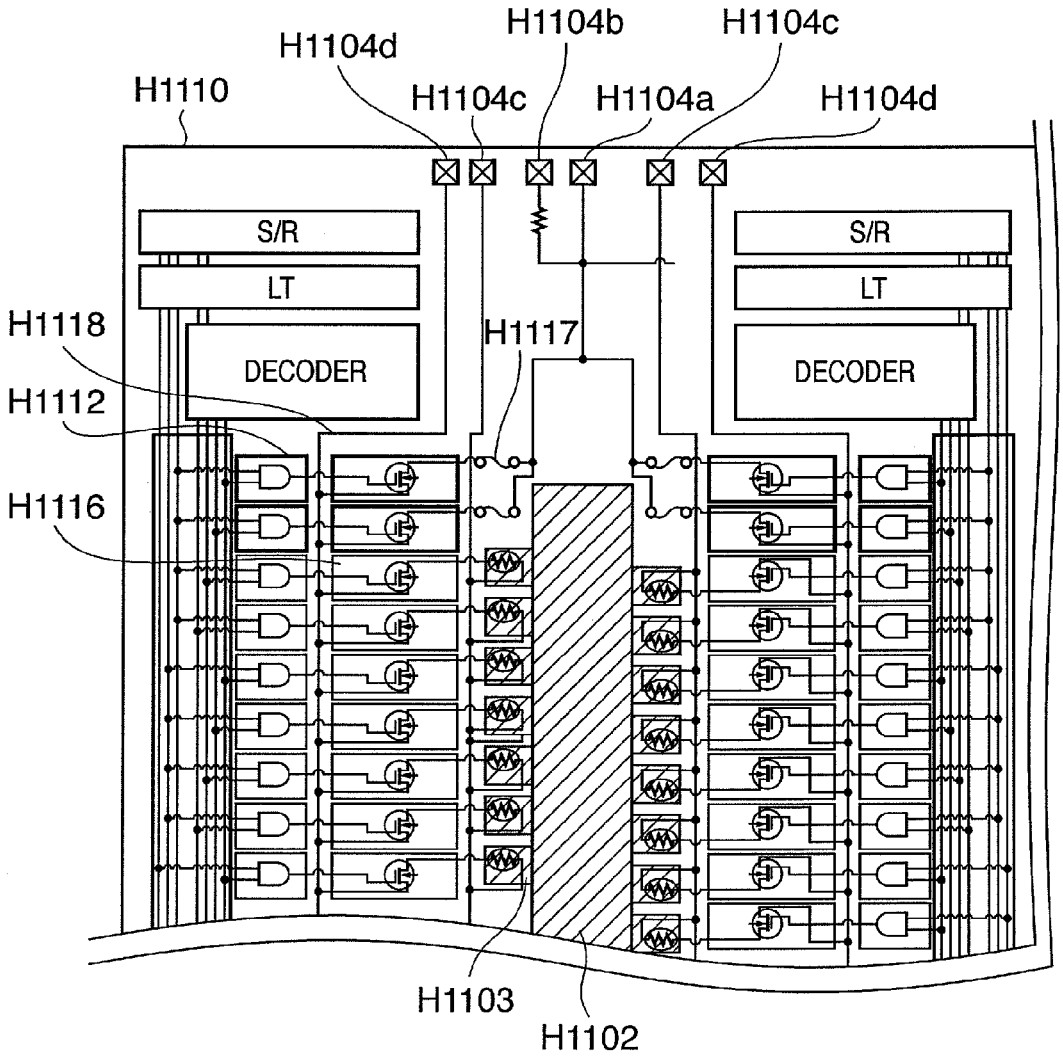
FIG. 18 is a view showing the circuit arrangement and layout of the main part of a head substrate according to the second modification of the first embodiment.

FIG. 18 is a view showing the layout of the head substrate according to the second modification.

As shown in FIG. 18, the fuse ROMs H1117 may be arranged between the ink supply port H1102 and the driving elements H1118, like the electrothermal transducers H1103. In this case, generally, the interval between the fuse ROM H1117 and the electrothermal transducer H1103 is preferably equal to or greater than the interval between the adjacent electrothermal transducers H1103 from the viewpoint of reliability.

Note that the above modification has the same circuit arrangement as described above.

SECOND EMBODIMENT

A more reliable and safe arrangement for inputting/outputting information to/from a fuse ROM will be described.

Figure 19:
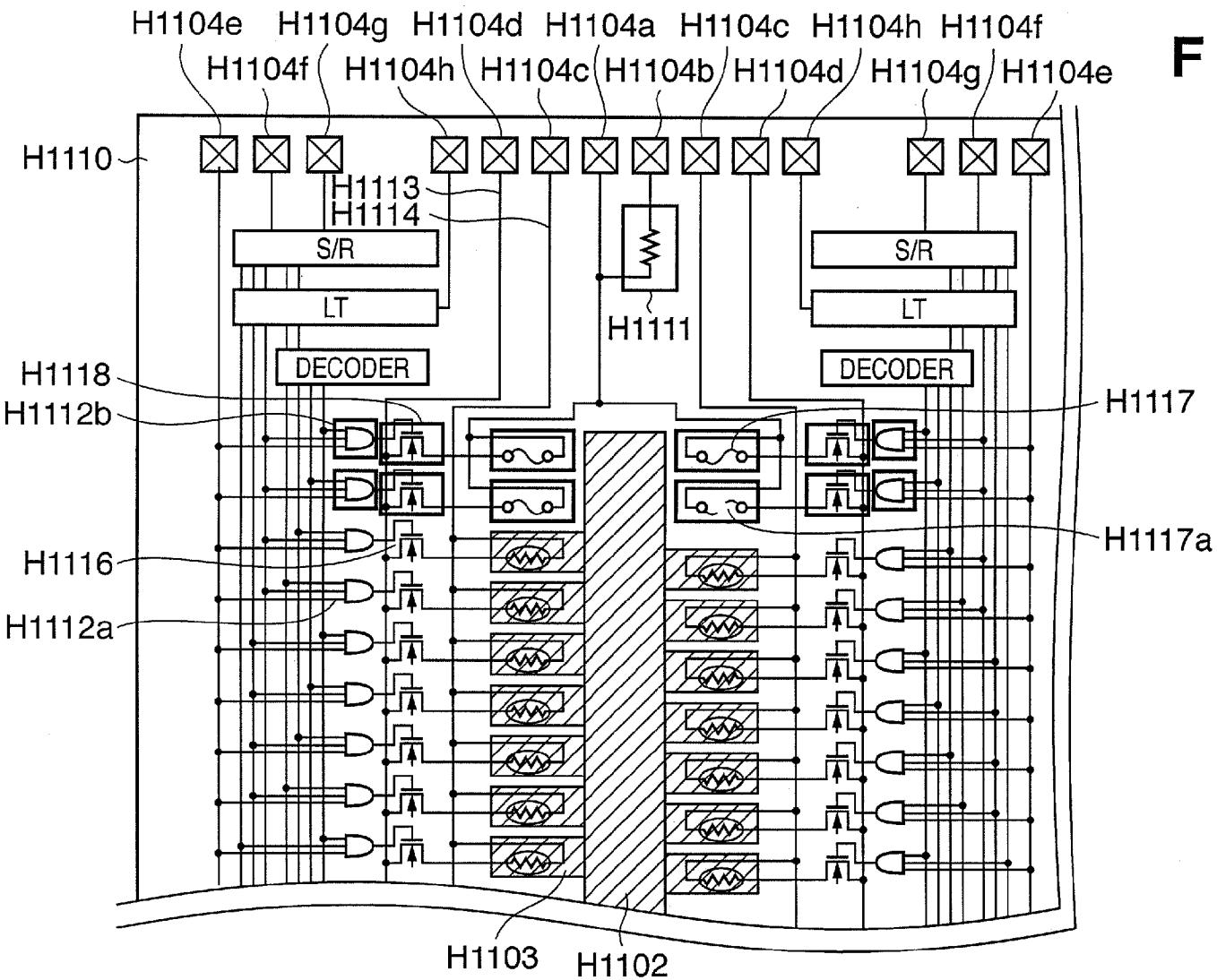
FIG. 19 is a view showing the arrangement of the head substrate according to the second embodiment.

FIG. 19 is a view showing the circuit arrangement and circuit layout of the main part of a head substrate H1110 according to the second embodiment. The head substrate H1110 of this embodiment can also write/read information unique to the head into/from a fuse ROM H1117.

Referring to FIG. 19, reference numeral H1104*e* denotes an enable signal (ENB) input pad; H1104*f*, a clock signal (CLK) input pad; H1104*g*, a data signal (DATA)/block selection signal (BE0 to BE3) input pad; and H1104*h*, a latch signal (LATCH) input pad. Hence, according to this embodiment, the enable signal (ENB) also controls information input/output to/from the fuse ROM.

This embodiment employs an arrangement where some of electrothermal transducers H1103 are replaced with the fuse ROMs H1117 which are formed without increasing the number of processes by using the same film as that of the resistor to form the electrothermal transducers or POLY wirings used for the gate wirings of the logic circuit, as in the second modification to the first embodiment.

Conventionally, the electrothermal transducers H1103, driving elements H1116, and selection circuits (AND circuits) H1112 are arranged at a very high density, e.g., at a resolution of 600 dpi. If the information amount is small (e.g., several bits to several ten bits), even though replacing some electrothermal transducers with the fuse ROMs, it is still possible to arrange the fuse ROMs H1117, the driving elements H1116 for the fuse ROMs, and selection circuits (AND circuits) H1112*b* almost without increasing the chip size.

Also in this embodiment, the logic circuit including the shift register, latch, and decoder arranged conventionally is used to select a fuse ROM, as in selecting an electrothermal transducer in the prior art. Hence, the number of elements need not increase for the selection operation. As described in the first embodiment, only two electrode pads and one resistive element are newly added so the chip size hardly increases.

<First Modification>

In the above-described second embodiment, the logic circuits and wirings for the normal printing operation are also used to drive the fuse ROMs. However, because of the characteristic of the fuse ROM, if the ON time of the driving elements used for the write or read is longer than the driving time (several hundred ns to 2 μs) of the electrothermal transducers, it is necessary in, e.g., the arrangement shown in FIG. 19 to newly set a long pulse width of the enable signal (ENB) input from the input pads H1104*e*.

On the other hand, in the conventional printing apparatus, the enable signal (ENB) has no unnecessarily long pulse width to prevent excess energy application to the electrothermal transducers, as already described above, from the viewpoint of safety and reliability. Therefore, if the pulse width of the enable signal (ENB) is long in accordance with the driving conditions of the fuse ROM, and the enable signal (ENB) with the long pulse width is erroneously applied to the electrothermal transducers, the electrothermal transducers may heavily be damaged.

If the printing apparatus side controls the signal to drive the fuse ROMs, and if the signal switching speed of the logic circuit is high, and ON/OFF of the output signal from the latch circuit to the AND circuit is properly defined, even the arrangement shown in FIG. 19 safely protects the electrothermal transducers. However, in order to obtain higher reliability and safety and properly cope with this situation, the driving element of the fuse ROM is turned on when the data signal (DATA) and block selection signals (BE0 to BE3) are defined by the latch signal (LATCH) regardless of whether the enable signal (ENB) is ON or OFF.

Figure 20:
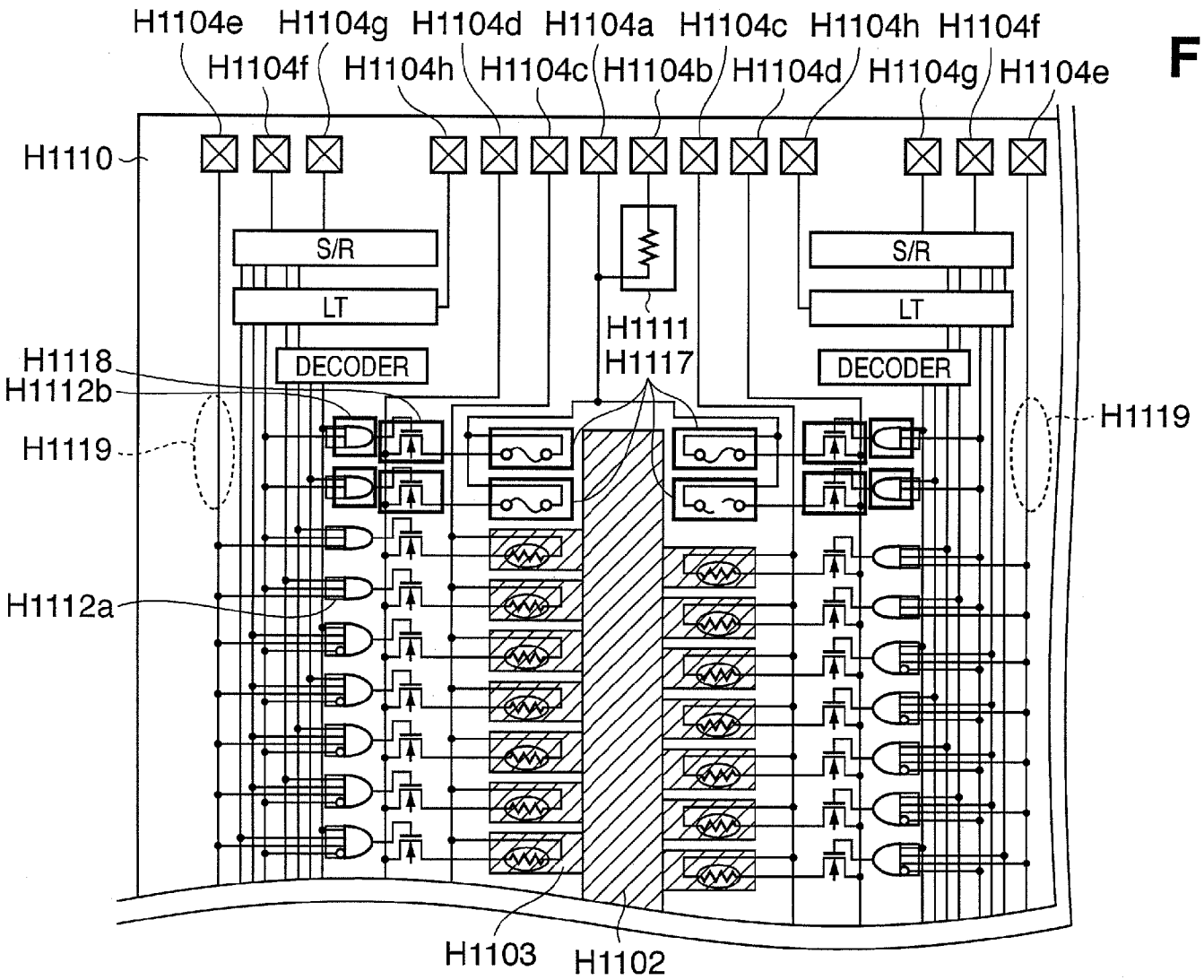
FIG. 20 is a view showing the circuit arrangement and layout of the main part of a head substrate according to the first modification of the second embodiment.

FIG. 20 is a view showing the circuit arrangement and layout of the main part of the head substrate H1110 according to the first modification to the second embodiment. The same reference numerals and reference symbols as in FIGS. 11, 13, 18, and 19 denote the same constituent elements in FIG. 20, and a description thereof will be omitted.

According to FIG. 20, AND circuits H1112*b* used for selecting the driving elements H1118 to drive the four fuse ROMs H1117 shown in FIG. 20 do not receive the enable signal (ENB), as indicated by a region H1119 surrounded by a broken line, unlike the AND circuits H1112*a* used for selecting the driving elements H1118 to drive the electrothermal transducers H1103. According to this circuit arrangement, the output from each AND circuit H1112*b* is turned on by the output signals from the latch circuit (LT) and decoder (DECODER) at the input timing of the latch signal (LATCH). In other words, fuse driving does not depend on ON/OFF of the enable signal to control heat generation of the electrothermal transducer.

In this example, a signal (above-described fuse enable selection signal) output from a shift register to select fuse driving and input to an AND circuit to select an electrothermal transducer except those used for fuse or printing, i.e., an electrothermal transducer used for printing has an inverted logic. Hence, when the fuse enable signal selects an electrothermal transducer not to be used for fuse or printing, the remaining electrothermal transducers to be used for printing are not selected. That is, an exclusive circuit arrangement further contributes to increasing the safety.

The arrangement of this example also prevents any increase in the number of elements and has no particular influence on the increase in head substrate size in circuit design.

Use of the arrangement shown in FIG. 20 allows more reliable information read especially when, in reading data from a fuse ROM, the access time for the printing apparatus side to receive information is 2 μs or less to result in delay of processing, or the output signal itself from the fuse ROM delays due to the capacitance component of the wiring.

<Second Modification>

When the output signal from the latch circuit is input, and the decoder (DECODER) decides the time-division selection signal (BLE) in the arrangement of the above-described first modification, signal delay in the decoder (DECODER) may cause instantaneous selection of a fuse ROM different from the fuse ROM to be selected. To prevent this and more reliably select a desired fuse ROM, the arrangement of the modification shown in FIG. 21 is used.

Figure 21:
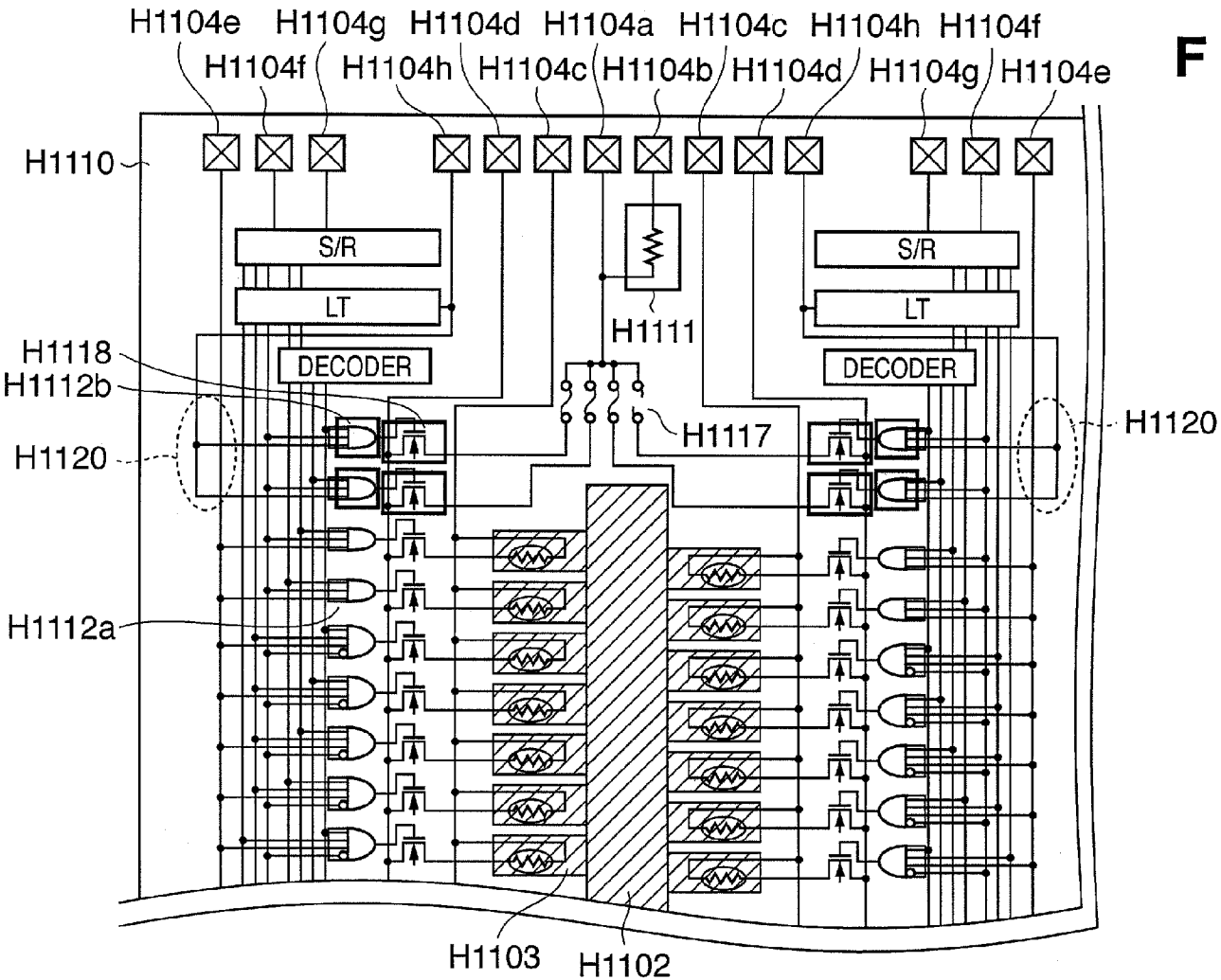
FIG. 21 is a view showing the circuit arrangement and layout of the main part of a head substrate according to the second modification of the second embodiment.

FIG. 21 is a view showing the arrangement of the head substrate H1110 according to the second modification to the second embodiment. The layout of fuses may be the same as in FIGS. 18 to 20. The same reference numerals and reference symbols as in FIGS. 11, 13, and 18 to 20 denote the same constituent elements in FIG. 21, and a description thereof will be omitted.

According to the arrangement shown in FIG. 21, the AND circuits H1112*b* to control the driving elements H1118 to drive the fuse ROMs H1117 receive the latch signal (LATCH), as indicated by a region H1120 surrounded by a broken line. In this arrangement, no fuse ROMs are driven during data latch (the latch signal is at low level "L (OFF)").

Figure 22:
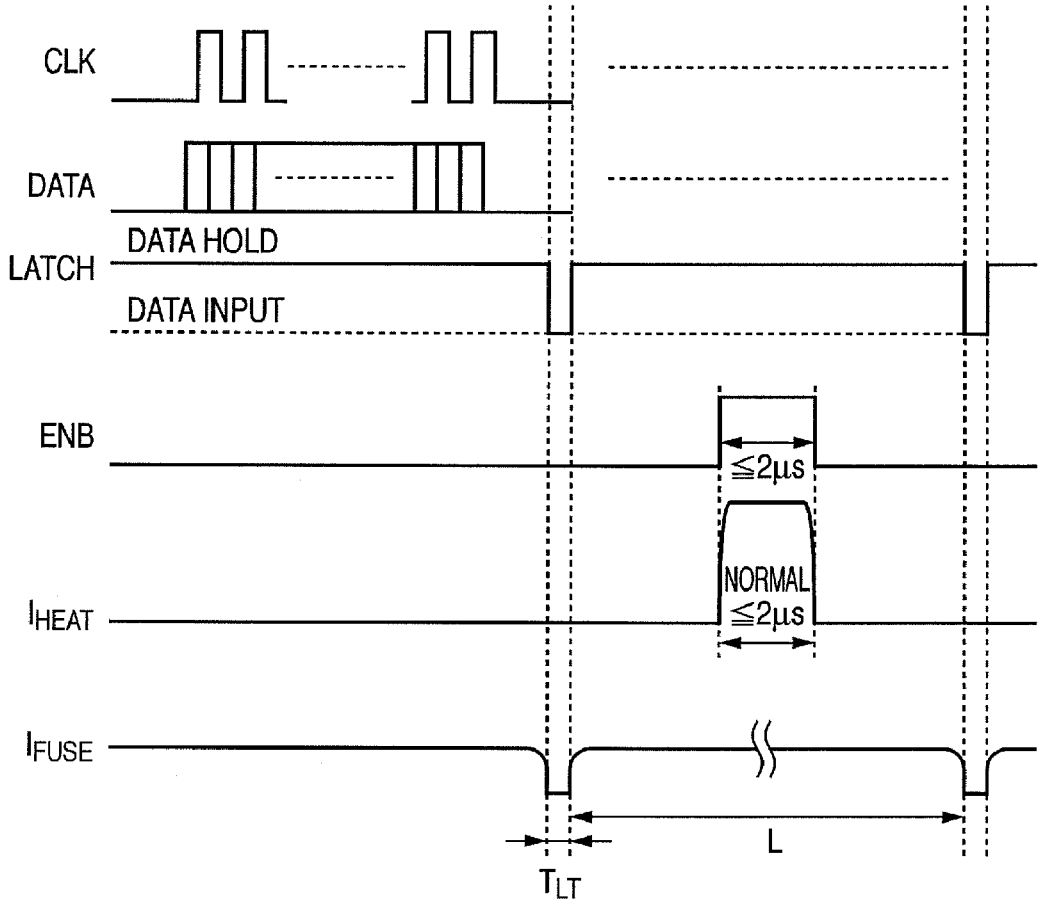
FIG. 22 is a timing chart of signals related to fuse ROM driving using the head substrates according to the first and second modifications of the second embodiment.
Figure 23:
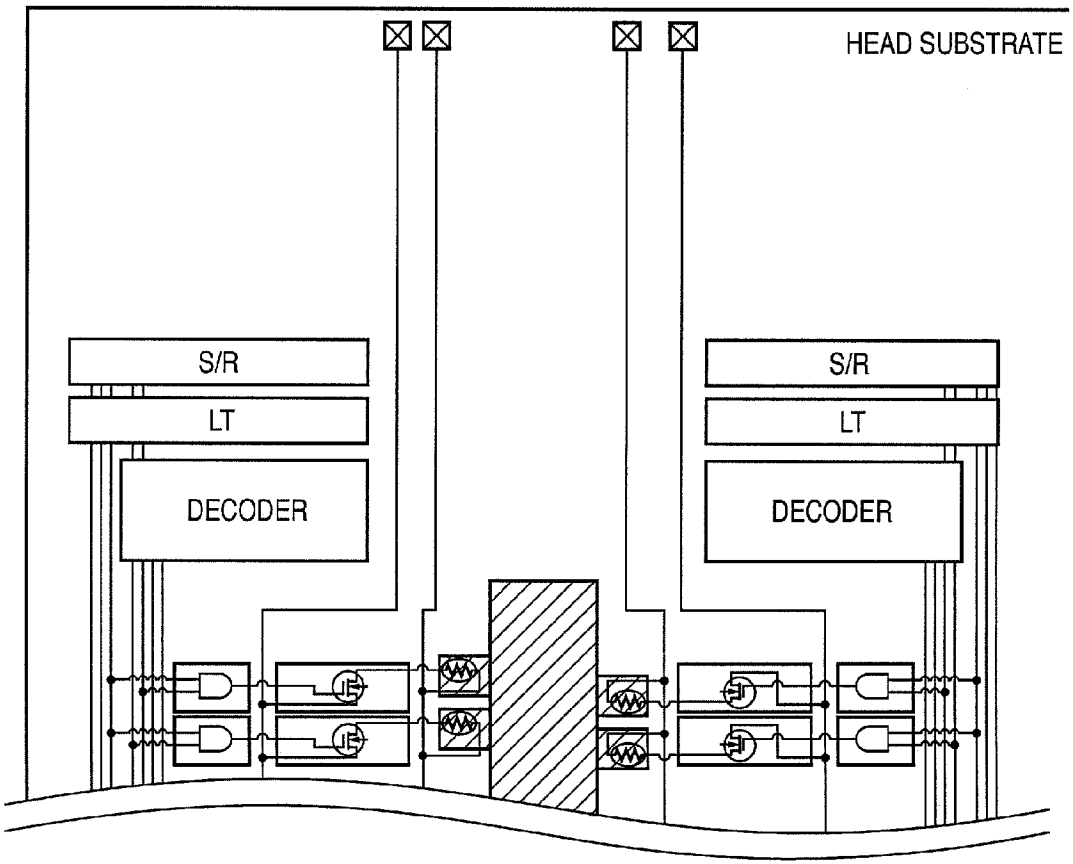
FIG. 23 is a view showing the circuit layout in a head substrate.

FIG. 22 is a timing chart of signals related to fuse ROM driving using the head substrate according to the second modification to the second embodiment.

As shown in FIG. 22, the interval of the latch signals is always longer than that of the enable signals (ENB) to flow a current to the electrothermal transducers and can separately be set. It is therefore possible to ensure a sufficient time (L) to read-access the fuse ROMs without preparing the longer enable signal (ENB) which might cause to give an excess energy to the electrothermal transducers.

This also applies to the first modification. In the first modification, however, a current flows to the fuse ROMs even during a period ($T_{LT}$) when the latch signal (LATCH) is at low level, unlike a case in FIG. 22. Hence, if the decoder (DECODER) delays signal definition, a current instantaneously flows to the electrothermal transducers or other fuse ROMs.

To the contrary, the second modification shown in FIG. 22 controls such that no fuse current ($I_{FUSE}$) flows during the period ($T_{LT}$) when the latch signal (LATCH) is at low level to input data to the latch circuit (LT). Hence, if the period ($T_{LT}$) when the latch signal (LATCH) is at low level is set to be sufficiently long, no fuse current ($I_{FUSE}$) flows during signal delay in the decoder (DECODER). This prevents instantaneous current flow to a fuse ROM different from a fuse ROM to be selected.

In the above-described embodiments, the droplet discharged from the printhead is an ink droplet, and the liquid stored in the ink tank is ink. However, the content is not limited to ink. The ink tank may store, e.g., process liquid that is discharged to the printing medium to increase the adhesion and water repellency of a printed image and/or increase the quality of the image.

If the above-described embodiments particularly employs an inkjet printing method in which means (e.g., an electrothermal transducer) for generating thermal energy as energy utilized to discharge ink and means for changing the ink state by the thermal energy are provided, high-density and high-precision printing can be achieved.

The present invention is also effective for the above-described serial type printhead, a printhead fixed to the apparatus main body, or an exchangeable cartridge type printhead capable of ensuring electrical connection to the apparatus main body when attached to it and receiving ink from the apparatus main body.

The inkjet printing apparatus of the present invention can take any form such as an image output device for an information processing device such as a computer, a copying machine combined with a reader, or a facsimile apparatus having a transmitting/receiving function.

The present invention is not limited to the above embodiments, and various changes and modifications can be made within the spirit and scope of the present invention. Therefore, to apprise the public of the scope of the present invention, the following claims are made.

CLAIM OF PRIORITY

This application claims the benefit of Japanese Patent Application No. 2004-164555, filed Jun. 2, 2004 and Japanese Patent Application No. 2005-149619, filed May 23, 2005 which are hereby incorporated by reference herein in their entirety.

The invention claimed is:

1. A head substrate comprising:

a plurality of printing elements for printing;

a plurality of first driving elements which correspond to said plurality of printing elements, respectively, for driving said plurality of printing elements;

a fuse ROM which stores information;

a second driving element for driving said fuse ROM;

input means for inputting a printing signal to cause said plurality of printing elements to print and a block selection signal to time-divisionally drive said plurality of printing elements;

selective driving means for selectively driving said plurality of first driving elements on the basis of the printing signal and the block selection signal input by said input means;

a first pad for applying a first voltage to said fuse ROM to write information; and a second pad for applying a second voltage to read out the information from said fuse ROM, wherein, in order to selectively drive said second driving element to operate said fuse ROM, said second driving element connects to said selective driving means, and said fuse ROM is selectively operative on the basis of signals input from said input means.

2. The head substrate according to claim 1, wherein said input means comprises:

a shift register for serially inputting the printing signal, and a latch circuit for latching the printing signal input by said shift register.

3. The head substrate according to claim 2, wherein said selective driving means comprises:

a decoder circuit for receiving the block selection signal as part of an output signal from said latch circuit, and generating a time-division selection signal to time-divisionally drive said plurality of printing elements, and an AND circuit for receiving the time-division selection signal and the printing signal as part of the output signal from said latch circuit, and calculating a logical product.

4. The head substrate according to claim 3, wherein said AND circuit further inputs a heat enable signal so as to energize and drive said plurality of first driving elements and said second driving element.

5. The head substrate according to claim 3, wherein said AND circuit provided to energize and drive said plurality of first driving elements further inputs a heat enable signal.

6. The head substrate according to claim 5, wherein said AND circuit provided to drive said second driving element further inputs a latch signal for instructing a latch operation of said latch circuit.

7. The head substrate according to claim 1, wherein a voltage applied to said plurality of printing elements substantially equals the first voltage.

8. The head substrate according to claim 7, wherein said first driving element and said second driving element have substantially the same tolerable voltage.

9. The head substrate according to claim 1, wherein a voltage that drives said input means and said selective driving means substantially equals the second voltage.

10. The head substrate according to claim 1, wherein said input means inputs a fuse ROM selection signal to select a fuse ROM to be operated.

11. The head substrate according to claim 1, further comprising a resistor, connected between said first pad and said second pad, whose resistance value is much higher than that of said fuse ROM.

12. The head substrate according to claim 1, wherein said plurality of printing elements comprise electrothermal transducers, and printing is performed by energizing said electrothermal transducers to generate heat and discharging ink by using the generated heat.

13. The head substrate according to claim 1, further comprising a rectangular ink supply port to supply the ink from an outside, wherein said plurality of printing elements are arrayed along both long sides of said ink supply port, said plurality of first driving elements are arrayed along a further side of the array of said printing elements spaced apart from the long side of said ink supply port, and said second driving element is arranged at least at one end of the array of said first driving elements.

14. A printhead using a head substrate according to claim 1.

15. An ink cartridge having a printhead according to claim 14 and an ink tank which stores ink to be supplied to the printhead.

16. A printing apparatus which prints by using a printhead according to claim 14.

17. The printing apparatus according to claim 16, further comprising:

write means for writing information into said fuse ROM by applying the first voltage to said first pad;

read means for reading out information from said fuse ROM by applying the second voltage to said second pad; and switching means for switching information write/read in/from said fuse ROM and a normal printing operation by transmitting the fuse selection signal.

18. A method for inputting/outputting information to/from a head substrate according to claim 1, comprising:

a switching step of switching information write/read in/from the fuse ROM and a normal printing operation by transmitting the fuse selection signal to the head substrate;

a write step of writing information into the fuse ROM by applying the first voltage to the first pad; and a read step of reading out information from the fuse ROM by applying the second voltage to the second pad.

* * * * *

UNITED STATES PATENT AND TRADEMARK OFFICE

CERTIFICATE OF CORRECTION

PATENT NO. : 7,309,120 B2
APPLICATION NO. : 11/564704
DATED : December 18, 2007
INVENTOR(S) : Hatsui et al.

It is certified that error appears in the above-identified patent and that said Letters Patent is hereby corrected as shown below:

COLUMN 2:
Line 56, “RON” should read --ROM--.

COLUMN 10:
Line 37, “HlllOa” should read --H1110a--.

COLUMN 14:
Line 4, “basis.” should read --basis--.

COLUMN 19:
Line 6, “ox” should read --or--.

Signed and Sealed this

Tenth Day of March, 2009

John Doll

JOHN DOLL
*Acting Director of the United States Patent and Trademark Office*